US011739407B2

(12) United States Patent
Takagi et al.

(10) Patent No.: US 11,739,407 B2
(45) Date of Patent: Aug. 29, 2023

(54) METHOD FOR PRODUCING NI-BASED ALLOY AND NI-BASED ALLOY

(71) Applicant: NIPPON STEEL CORPORATION, Tokyo (JP)

(72) Inventors: Takamitsu Takagi, Tokyo (JP); Masaaki Terunuma, Tokyo (JP); Kiyoko Takeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 203 days.

(21) Appl. No.: 16/767,451

(22) PCT Filed: Nov. 28, 2018

(86) PCT No.: PCT/JP2018/043878
§ 371 (c)(1),
(2) Date: May 27, 2020

(87) PCT Pub. No.: WO2019/107456
PCT Pub. Date: Jun. 6, 2019

(65) Prior Publication Data

US 2020/0392612 A1 Dec. 17, 2020

(30) Foreign Application Priority Data

Nov. 28, 2017 (JP) ..... 2017-228397

(51) Int. Cl.
*C22F 1/10* (2006.01)
*C22C 19/05* (2006.01)

(52) U.S. Cl.
CPC ..... *C22F 1/10* (2013.01); *C22C 19/055* (2013.01)

(58) Field of Classification Search
None
See application file for complete search history.

(56) References Cited

U.S. PATENT DOCUMENTS

2015/0144290 A1 5/2015 Miyamoto et al.
2015/0159241 A1* 6/2015 Hamaguchi ..... C22C 30/00 420/443

FOREIGN PATENT DOCUMENTS

CN 104010747 A 8/2014
JP 60211029 A 10/1985
(Continued)

OTHER PUBLICATIONS

Special Metals Corporation, "INCONEL alloy 625", Aug. 2013, https://www.specialmetals.com/documents/technical-bulletins/inconel/inconel-alloy-625.pdf (Year: 2013).*
(Continued)

*Primary Examiner* — Brian D Walck
(74) *Attorney, Agent, or Firm* — Greer, Burns & Crain, Ltd.

(57) ABSTRACT

The production method of a Ni-based alloy according to the present embodiment includes: a casting step of casting a liquid alloy which is a raw material of the Ni-based alloy to produce a Ni-based alloy starting material; and a segregation reducing step of performing, on the Ni-based alloy starting material produced by the casting step, heat treatment, or the heat treatment and complex treatment including hot working and heat treatment after the hot working, to satisfy Formula (1):

where, each symbol in Formula (1) is as follows:

$$V_R^{-0.294} \leq 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} \quad (1)$$

$V_R$: Solidification cooling rate (° C./min) of the liquid alloy, $T_n$: Holding temperature (° C.) in the n-th heat treatment, (Continued)

$t_n$: Holding time (hr) at the holding temperature in the n-th heat treatment, $Rd_{n-1}$: Cumulative area reduction ratio (%) of the Ni-based alloy starting material before the n-th heat treatment, and N: Total number of the heat treatment.

18 Claims, 4 Drawing Sheets

(56) References Cited

FOREIGN PATENT DOCUMENTS

| | | | |
|---|---|---|---|
| JP | 1136939 | A | 5/1989 |
| JP | 6312250 | A | 11/1994 |
| WO | 2010038680 | A1 | 4/2010 |

OTHER PUBLICATIONS

J Plat Pat machine translation of JP H01-136939 (Year: 2022).*

ASTM E112, ASTM International, Published Dec. 2010, DOI: 10.1520/E0112-10. (Year: 2010).*

M. Rozmus-Górnikowska et al., Microstructure and Microsegregation of an Inconel 625 Weld Overlay Produced on Steel Pipes by The Cold Metal Transfer Technique; Oct. 28, 2014, pp. 1081-1084.

ISR issued in Int'l. Application No. PCT/JP2018/043878, dated Feb. 26, 2019.

* cited by examiner

METHOD FOR PRODUCING NI-BASED ALLOY AND NI-BASED ALLOY

This is a National Phase Application filed under 35 U.S.C. § 371, of International Application No. PCT/JP2018/043878, filed Nov. 28, 2018, the contents of which are incorporated by reference.

TECHNICAL FIELD

The present invention relates to a method for producing a Ni-based alloy, and a Ni-based alloy.

BACKGROUND ART

Members used in oil refinery facilities and chemical plant facilities, and geothermal power generation facilities, etc. are exposed to a high-temperature corrosive environment containing hydrogen sulfide, carbon dioxide, various acid solutions, and the like. The high-temperature corrosive environment may reach 1100° C. at maximum. Therefore, excellent strength at high temperatures as well as excellent corrosion resistance is required of members to be used in facilities in high-temperature corrosive environments.

There is known a Ni-based alloy containing a large amount of Cr and Mo as a material which is usable for such facilities. This Ni-based alloy exhibits excellent corrosion resistance due to containing Cr and Mo.

Meanwhile, the Ni-based alloy contains multiple kinds of alloying elements. Therefore, in the process of casting the melted liquid alloy, the alloying elements may be concentrated between secondary arms of dendrite which is generated during solidification. In this occasion, segregation occurs in the Ni-based alloy. In particular, Mo which has an effect of improving corrosion resistance is likely to segregate. Upon segregation of Mo, the corrosion resistance of the Ni-based alloy deteriorates.

International Application Publication No. WO2010/038680 (Patent Literature 1) proposes a method for suppressing segregation in Ni-based alloy. In this literature, a liquid alloy of Ni-based alloy is melted by vacuum melting. Then, the liquid alloy is cast to produce a Ni-based alloy starting material. Further, as needed, the Ni-based alloy starting material is subjected to secondary melting such as vacuum arc remelting (VAR) or electro-slag remelting (ESR), to achieve further segregation suppressing effects. Next, the Ni-based alloy starting material is subjected to a homogenizing treatment at 1160 to 1220° C. for 1 to 100 hours. Patent Literature 1 states that as a result of this, segregation of Ni-based alloy is suppressed.

CITATION LIST

Patent Literature

Patent Literature 1: International Application Publication No. WO2010/038680

Patent Literature 2: Japanese Patent Application Publication No. 60-211029

SUMMARY OF INVENTION

Technical Problem

In Patent Literature 1, after primary melting by vacuum melting is performed and further, as needed, secondary melting such as VAR or ESR is performed, homogenizing treatment of long hours is performed. For that reason, when the production method of Patent Literature 1 is adopted, production cost may increase. Therefore, in the Ni-based alloy, there may be another method for reducing Mo segregation.

It is an object of the present invention to provide a method for producing a Ni-based alloy, and a Ni-based alloy, which can reduce Mo segregation.

Solution to Problem

A method for producing a Ni-based alloy according to the present invention includes:

a casting step of casting a liquid alloy to produce a Ni-based alloy starting material, which has a chemical composition consisting of: in mass %, C: 0.100% or less Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less O: 0.1000% or less, Co: 0 to 1.00%, Cu: 0 to 0.50%, one or more elements selected from the group consisting of Ca, Nd, and B: 0 to 0.5000%, and the balance being Ni and impurities; and a segregation reducing step of performing, on the Ni-based alloy starting material produced by the casting step, heat treatment, or the heat treatment and, after the heat treatment, complex treatment including hot working and heat treatment after the hot working, to satisfy Formula (1):

[Expression 1]

$$V_R^{-0.294} \leq 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} \quad (1)$$

where, each symbol in Formula (1) is as follows:

$V_R$: Solidification cooling rate (° C./min) of the liquid alloy in the casting step, $T_n$: Holding temperature (° C.) in the n-th heat treatment, $t_n$: Holding time (hr) at the holding temperature in the n-th heat treatment, $Rd_{n-1}$: Cumulative area reduction ratio (%) of the Ni-based alloy starting material before the n-th heat treatment, and N: Total number of the heat treatment.

A Ni-based alloy according to the present invention has a chemical composition consisting of: in mass %, C: 0.100% or less Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less O: 0.1000% or less, Co: 1.0% or less, Cu: 0.50% or less, one or more elements selected from the group consisting of Ca, Nd, and B: 0 to 0.5000%, and the balance being Ni and impurities, wherein in a section perpendicular to a longitudinal direction of the Ni-based alloy, an average concentration of Mo is 8.0% or more in mass %; a maximum value of the Mo concentration is 11.0% or less in mass %; and further an area fraction of a region, in which the Mo concentration is less than 8.0% in mass %, is less than 2.0%.

Advantageous Effects of Invention

The method for producing Ni-based alloy according to the present invention can reduce Mo segregation of the Ni-based alloy. The Ni-based alloy according to the present invention, in which Mo segregation is suppressed, exhibits excellent corrosion resistance.

DESCRIPTION OF EMBODIMENTS

The present inventors have considered that in order to achieve excellent corrosion resistance in a high-temperature corrosive environment, a Ni-based alloy having a high Mo content is suitable, and specifically a Ni-based alloy having a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00, N: 0.100% or less, O: 0.1000% or less, Co: 0 to 1.00%, Cu: 0 to 0.50%, one or more elements selected from the group consisting of Ca, Nd, and B: 0 to 0.5000%, and the balance being Ni and impurities is suitable. Then, the present inventors conducted investigation and study on the method of reducing Mo segregation in a high-Mo Ni-based alloy having the above-described chemical composition. As a result, the present inventions have obtained the following findings.

[Relationship Between Dendrite Secondary Arm Spacing and Solidification Cooling Rate in the Casting Process]

The concentration distribution of Mo in the Ni-based alloy having the above-described chemical composition has a correlation with the dendrite secondary arm spacing which is formed in a final solidification stage in the casting step.

Figure 1:
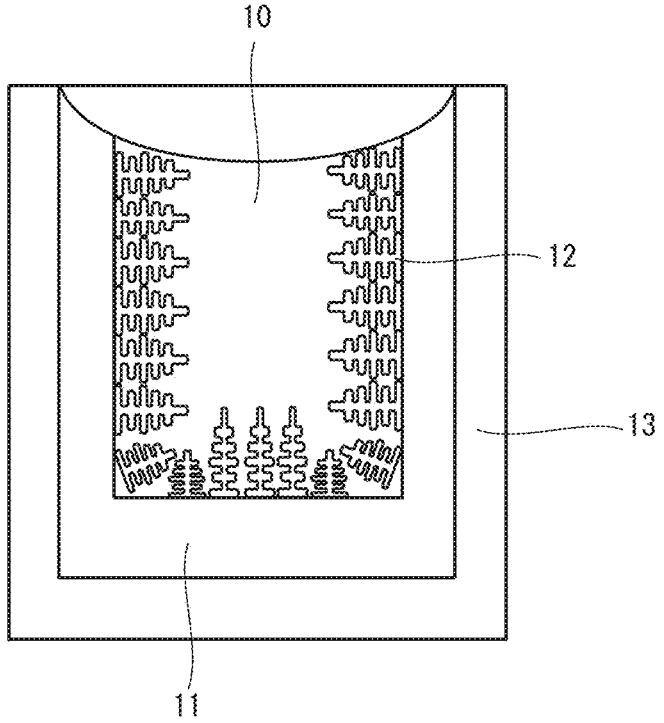
FIG. 1 is a schematic diagram of a Ni-based alloy during solidification in a casting step.

FIG. 1 is a schematic diagram of a Ni-based alloy while solidifying in a casting step. Referring to FIG. 1, a liquid alloy in a mold 13 is cooled so that solidification progresses in the casting step. Specifically, a portion in the vicinity of the mold 13 solidifies, and thereby formation of a solid phase 11 progresses. Further, in a liquid phase 10, dendrite 12 is being formed in the portion in which solidification progresses.

Figure 2:
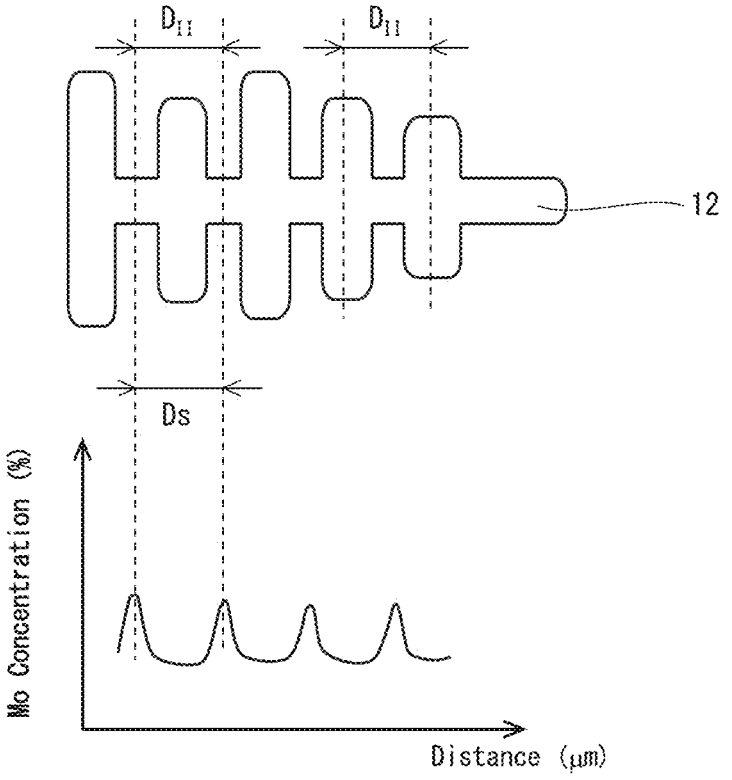
FIG. 2 is a diagram to show relationship between dendrite in FIG. 1 and Mo concentration of Ni-based alloy.

FIG. 2 is a diagram to show relationship between dendrite 12 in FIG. 1 and the Mo concentration in a Ni-based alloy. Referring to FIG. 2, in the Mo concentration distribution in the Ni-based alloy starting material (cast material) after casting, a portion in which the Mo concentration is high is defined as a positive segregation part of Mo segregation, and a portion in which the Mo concentration is low is defined as a negative segregation part of Mo segregation. Then, spacing between adjacent Mo segregations (spacing between the positive segregation parts, or spacing between negative segregation parts) is defined as a Mo inter-segregation distance Ds. As shown in FIG. 2, the Mo inter-segregation distance Ds corresponds to the dendrite secondary arm spacing $D_{II}$. In FIG. 2, as an example, the Mo inter-segregation distance Ds coincides with the dendrite secondary arm spacing $D_{II}$.

Figure 3:
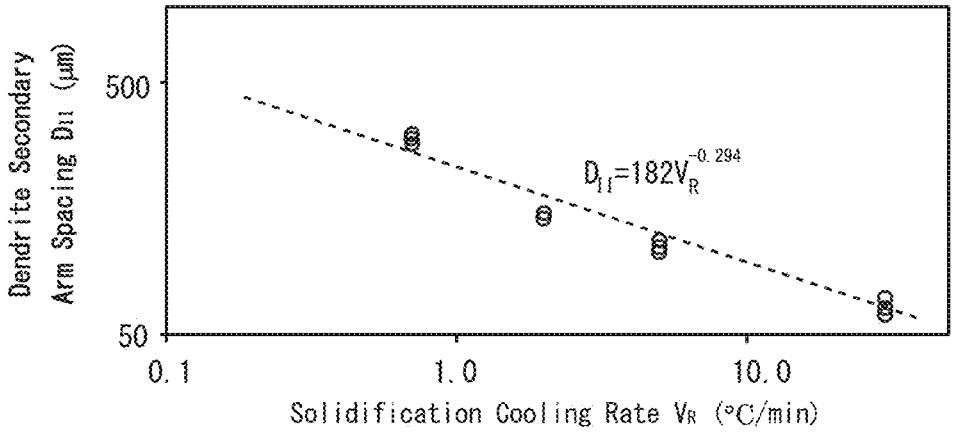
FIG. 3 is a diagram to show relationship between dendrite secondary arm spacing DR and solidification cooling rate $V_R$ in the Ni-based alloy starting material (cast material) having a chemical composition of the present invention.

FIG. 3 is a diagram to show relationship between the dendrite secondary arm spacing $D_{II}$ and solidification cooling rate $V_R$ in a Ni-based alloy starting material (cast material) having the above-described chemical composition. FIG. 3 was obtained by the following method. A liquid alloy of Ni-based alloy was melted. Then, the liquid alloy was cooled to the normal temperature (25° C.) at various solidification cooling rates $V_R$ to produce a plurality of Ni-based alloy starting materials (ingots) having the above-described chemical composition. In this experiment, the solidification cooling rate $V_R$ was defined as an average cooling rate (° C./min) in a temperature range of the liquid solution from the temperature at the start of casting to the temperature at the completion of solidification (the temperature at the completion of solidification is 1290° C.). The temperature of the Ni-based alloy during cooling was measured by using a consumable thermocouple.

Here, in the present description, a section perpendicular to the longitudinal direction of the Ni-based alloy starting material is defined as a "cross section", and the width of the Ni-base alloy starting material in the cross section is defined as W. When the cross section is of a rectangular shape, the long side of the cross section is defined as the width W. When the cross section is of a circular shape, the diameter is defined as the width W. Moreover, in the cross section, a region at a W/4 depth in the width W direction from a surface perpendicular to the width W direction is defined as a "W/4 depth position".

The produced Ni-based alloy starting material was cut in a direction perpendicular to the longitudinal direction. Then, the dendrite secondary arm spacing $D_{II}$ (μm) was measured at a W/4 depth position of the cross section. Specifically, a sample was collected from the W/4 depth position. Of the surface of the sample, mirror polishing was performed on a surface in parallel with the above-described cross section, and thereafter etching by aqua regia was performed thereon. The etched surface was observed by an optical microscope of a magnification of 400 times to generate a photographic image of an observation field of view of 200 μm×200 μm. Using the obtained photographic image, the dendrite secondary arm spacing (μm) was measured at arbitrary 20 locations within the observation field of view. An average of the measured dendrite secondary arm spacing was defined as a dendrite secondary arm spacing $D_{II}$ (μm). FIG. 3 was created by using the obtained solidification cooling rate $V_R$ and the dendrite secondary arm spacing $D_{II}$.

Referring to FIG. 3, in the Ni-based alloy starting material of the above-described chemical composition, the dendrite secondary arm spacing $D_{II}$ becomes narrower as the solidification cooling rate $V_R$ increases. Based on the result of FIG. 3, in the Ni-based alloy starting material of the above-described chemical composition, the dendrite secondary arm spacing $D_{II}$ (μm) can be defined by the following Formula (A) by using the solidification cooling rate $V_R$ (° C./min).

$$D_{II}=182V_R^{-0.294} \quad \text{(A)}$$

[Diffusion Distance of Mo in Heat Treatment]

Suppose a case in which the Ni-based alloy starting material produced by a casting step is subjected to heat treatment. At this time, the Mo diffusion distance in the Ni-based alloy starting material can be defined as follows.

Diffusion equation is defined by the following Formula (B):

$$\sigma^2=2D\times t \quad \text{(B)}$$

where, σ in Formula (B) is an average distance over which Mo moves in time t (hr) in the Ni-based alloy starting material of the above-described chemical composition (hereinafter, referred to as a diffusion distance: the unit is μm). Moreover, D in Formula (B) is a diffusion coefficient of Mo, and is defined by the Arrhenius equation of Formula (C):

$$D=D_0\exp(-Q/R(T+273)) \quad \text{(C)}$$

where, Q in Formula (C) is activation energy of Mo diffusion. Moreover, R is the gas constant, and T is temperature (° C.). $D_0$ is a constant (pre-exponential factor) of Mo in the Ni-based alloy.

$D_0$ was determined by the following experiment. A Ni-based alloy starting material having the above-described chemical composition was subjected to heat treatment at 1248° C. for 48 hours. Then, the diffusion distance σ of Mo in the Ni-based alloy after heat treatment was determined. More specifically, the following experiment was performed. According to the method, the dendrite secondary arm spacing $D_{II}$ of the Ni-based alloy starting material before heat treatment was measured. After the measurement, the Ni-based alloy starting material was retained at a holding temperature of 1248° C. At this moment, heat treatment was performed for various holding times. After heat treatment, the Mo concentration difference between the positive segregation part of Mo and the negative segregation part of Mo was measured at a W/4 depth position of the Ni-based alloy starting material. The concentration difference of Mo between the positive segregation part and the negative segregation part for each holding time in the heat treatment. Then, the holding time t at which the concentration difference becomes 1.0 mass % or less was determined. Note that all of the dendrite secondary arm spacings $D_{II}$ of Ni-based alloy of the Ni-based alloy starting material used in the test were 120.6 μm. Since the diffusion distance of Mo is given as $\sigma=D_{II}/2$, the Mo diffusion distance σ was 60.3 μm. As a result of the above-described test, when heat treatment at a holding temperature of 1248° C. and for a holding time t of 48 hours was performed, the concentration difference between the positive segregation part and the negative segregation part of Mo became 1.0 mass % or less.

Based on the item obtained by the above-described experiment (the experimental result indicating that when the diffusion distance σ is 60.3 μm, if the temperature T=1248° C. and the holding time t=48 hours, the concentration difference between the positive segregation part and the negative segregation part of Mo is 1.0 mass % or less), Mo activation energy Q=240 kJ/mol in a range of 1050 to 1360° C., and Formula (B) and Formula (C), the diffusion distance σ of Mo at holding temperature T (° C.) and for the holding time t (hr) will be as shown by the following Formula (D). Note that regarding the activation energy, the activation energy value of Mo in the above-described temperature range in an austenite steel is substituted for the activation energy value of Mo in the Ni-based alloy.

[Expression 2]

$$\sigma = 1.16\times 10^5\sqrt{\exp\left(\frac{-2.89\times 10^4}{T+273}\right)\cdot t} \quad \text{(D)}$$

[Relationship Between Dendrite Secondary Arm Spacing $D_{II}$ and Diffusion Distance σ of Mo]

Referring to Formulae (A) and (D), if the diffusion distance σ of Mo in heat treatment, which is defined by Formula (D) becomes not less than ½ of the dendrite secondary arm spacing $D_{II}$, which is defined by Formula (A), (that is, Mo inter-segregation distance Ds), it is conceivable that Mo segregation can be improved by heat treatment. That is, if the holding temperature T (° C.), the holding time t (hr), and the solidification cooling rate $V_R$ (° C./min) satisfy Formula (O), Mo segregation will be sufficiently reduced in the heat treatment.

[Expression 3]

$$V_R^{-0.294} \le 1.27\times 10^3\sqrt{\exp\left(\frac{-2.89\times 10^4}{T_n+273}\right)\cdot t} \quad \text{(0)}$$

[Further Improvement of Mo Segregation by Hot Working]

Performing hot working on a Ni-based alloy starting material before heat treatment will allow the Mo inter-segregation distance Ds to be further decreased before the heat treatment. Because, the dendrite arm grows by extending in a normal direction of the surface of the Ni-based alloy starting material, as shown in FIG. 1. In the hot working, rolling reduction is applied in a normal direction of the surface of the Ni-based alloy starting material. For that reason, when hot working is performed, the dendrite secondary arm spacing $D_{II}$ (that is, the Mo inter-segregation distance Ds) decreases compared with a case in which hot working is not performed. Therefore, when heat treatment is performed at the same holding temperature T (° C.) and for the same holding time t (hr), it becomes easier to reduce segregation of Mo in a case in which hot working is performed before heat treatment, than in a case in which hot working is not performed before heat treatment.

Here, suppose that hot working is performed at a reduction of area Rd on the Ni-based alloy starting material after casting step, and heat treatment is performed on the Ni-based alloy starting material after hot working. In this case, it is inferred that the Mo inter-segregation distance Ds decreases by an amount corresponding to the reduction of area Rd. Conversely, it can be regarded as that the Mo diffusion distance $\sigma$ in the heat treatment extends by an amount corresponding to the reduction of area Rd.

Taking the above-described items into consideration, when hot working is performed at a reduction of area Rd before heat treatment, the following Formula (E) holds based on Formula (D).

[Expression 4]

$$\sigma = 1.16\times10^5\sqrt{\left(1-\frac{Rd}{100}\right)^{-1}\cdot\exp\left(\frac{-2.89\times10^4}{T+273}\right)\cdot t} \quad \text{(E)}$$

Based on the above-described study, performing hot working before heat treatment will further facilitate reduction of Mo segregation. Here, a series of treatments in which hot working is performed, and further, heat treatment is performed after the hot working (that is, a combined treatment of hot working at one time, and heat treatment at one time which is performed after the hot working) is defined as "complex treatment". When the complex treatment is performed one or more times repeatedly on the Ni-based alloy starting material, Formula (1) holds based on Formula (E):

[Expression 5]

$$V_R^{-0.294} \le 1.27\times10^3\sum_{n=1}^{N}\sqrt{\left(1-\frac{Rd_{n-1}}{100}\right)^{-1}\cdot\exp\left(\frac{-2.89\times10^4}{T_n+273}\right)\cdot t_n} \quad (1)$$

where, each symbol in Formula (1) indicates the followings.

$V_R$: Solidification cooling rate (° C./min) in the casting step $T_n$: Holding temperature (° C.) in the n-th heat treatment $t_n$: Holding time (hr) at the holding temperature in the n-th heat treatment $Rd_{n-1}$: Cumulative area reduction ratio (%) of the Ni-based alloy starting material before the n-th heat treatment N: Total number of heat treatment Here, n is a natural number of 1 to N, and N is a natural number.

The cumulative area reduction ratio $Rd_{n-1}$ is defined by the following Formula (F):

$$Rd_{n-1}=(1-(S_{n-1}/S_0))\times100 \quad \text{(F)}$$

where, $S_{n-1}$ indicates an area ($mm^2$) of a section perpendicular to the longitudinal direction (a cross section) of the Ni-based alloy starting martial before the n-th heat treatment. So is an area ($mm^2$) of a section perpendicular to the longitudinal direction (a cross section) of the Ni-based alloy starting material after the casting step and before the first hot working (that is, after the casting step, and before the segregation reduction step). When the Ni-based alloy starting material to be the object of $S_0$ is an ingot, and the section perpendicular to the longitudinal direction is not constant in the longitudinal direction as typified by a truncated square pyramid shape, the area $S_0$ is defined as follows:

$$S_0=V_0/L$$

where, $V_0$ is a volume ($mm^3$) of the Ni-based alloy starting material, and L is a length (mm) in the longitudinal direction of the Ni-based alloy starting material.

Note that when hot working is not performed, the cumulative area reduction ratio $Rd_{n-1}=0$ (an as-cast material).

The production method of a Ni-based alloy of the present embodiment, which has been completed based on the above-described findings, and the Ni-based alloy to be produced by the production method of the present embodiment has the following configurations.

A method for producing a Ni-based alloy according to the configuration of [1] includes:

a casting step of casting a liquid alloy to produce a Ni-based alloy starting material, which has a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less, O: 0.1000% or less, Co: 0 to 1.00%, Cu: 0 to 0.50%, one or more elements selected from the group consisting of Ca, Nd, and B: 0 to 0.5000%, and the balance being Ni and impurities, and a segregation reducing step of performing, on the Ni-based alloy starting material produced by the casting step, heat treatment, or the heat treatment and, after the heat treatment, complex treatment including hot working and heat treatment after the hot working, to satisfy Formula (1):

[Expression 6]

$$V_R^{-0.294} \le 1.27\times10^3\sqrt{\left(1-\frac{Rd_{n-1}}{100}\right)^{-1}\cdot\exp\left(\frac{-2.89\times10^4}{T_n+273}\right)\cdot t_n} \quad (1)$$

where, each symbol in Formula (1) is as follows:

$V_R$: Solidification cooling rate (° C./min) of the liquid alloy in the casting step, $T_n$: Holding temperature (° C.) in the n-th heat treatment, $t_n$: Holding time (hr) at the holding temperature in the n-th heat treatment, $Rd_{n-1}$: Cumulative area reduction ratio (%) of the Ni-based alloy starting material before the n-th heat treatment, and N: Total number of the heat treatment.

A method for producing a Ni-based alloy according to the configuration of [2] is the method for producing a Ni-based alloy according to [1], wherein the holding temperature is 1000 to 1300° C.

A method for producing a Ni-based alloy according to the configuration of [3] is the method for producing a Ni-based alloy according to [2], wherein in the segregation reducing step, the complex treatment is performed one or more times, and hot working is performed at least one time at an area reduction ratio of 35.0% or more on the Ni-based alloy starting material which has been heated to 1000 to 1300° C.

In this case, the grain size number conforming to ASTM E112 of the produced Ni-based alloy will be 0.0 or more.

A method for producing a Ni-based alloy according to the configuration of [4] is the method for producing a Ni-based alloy according to [2] or [3], wherein in the segregation reducing step, heat treatment in which the holding temperature is 1000 to 1300° C. and the holding time is 1.0 hour or more is performed at least one time.

In this case, a total number of Nb carbonitride whose maximum length is 1 to 100 μm will be $4.0\times10^{-2}/\mu m^2$ or less. As a result, hot workability will further improved.

A method for producing a Ni-based alloy according to the configuration of [5] is the method for producing a Ni-based alloy according to any one of [1] to [4], wherein the chemical composition of the Ni-base alloy starting material contains one or more elements selected from the group consisting of Ca, Nd, and B by a content that satisfies Formula (2):

$$(Ca+Nd+B)/S\geq2.0 \quad (2)$$

where, each symbol of element in Formula (2) is substituted by a content in atomic % (at) of the corresponding element.

In this case, the hot workability of the produced Ni-base alloy is further improved.

A Ni-based alloy according to configuration of [6] has a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less, O: 0.1000% or less, Co: 0 to 1.0%, Cu: 0 to 0.50%, one or more elements selected from the group consisting of Ca, Nd, and B: 0 to 0.5000%, and the balance being Ni and impurities, wherein in a section perpendicular to a longitudinal direction of the Ni-based alloy, an average concentration of Mo is 8.0% or more in mass %; a maximum value of the Mo concentration is 11.0% or less in mass %; and further an area fraction of a region in which the Mo concentration is less than 8.0% in mass % is less than 2.0%.

Mo segregation is suppressed in the Ni-based alloy according to the present embodiment. Therefore, the Ni-based alloy of the present embodiment has excellent corrosion resistance.

A Ni-based alloy according to configuration of [7] is the Ni-based alloy according to [6], wherein the chemical composition contains one or more elements selected from the group consisting of Ca, Nd, and B by a content that satisfies Formula (2):

$$(Ca+Nd+B)/S\geq2.0 \quad (2)$$

where, each symbol of element in Formula (2) is substituted by a content in atomic % (at) of a corresponding element.

In this case, the hot workability of the Ni-base alloy is further improved.

A Ni-based alloy according to configuration of [8] is the Ni-based alloy according to [6] and [7], wherein the grain size number conforming to ASTM E112 is 0.0 or more.

In this case, the hot workability of the Ni-based alloy is further improved.

A Ni-based alloy according to configuration of [9] is the Ni-based alloy according to any one of [6] to [8], wherein a total number of Nb carbonitride whose maximum length is 1 to 100 μm is $4.0\times10^{-2}/\mu m^2$ or less in the Ni-based alloy.

In this case, the hot workability of the Ni-based alloy is further improved.

Here, in the present description, "Nb carbonitride" is a concept including Nb carbide, Nb nitride, and Nb carbonitride, and indicates a precipitate whose total content of Nb, C, and N is, in mass %, 90% or more. Moreover, a maximum length of Nb carbonitride refers to a longest straight line of those that connect arbitrary two points on an interface (boundary) between Nb carbonitride and the mother phase.

Hereinafter, a method for producing a Ni-based alloy, and a Ni-based alloy according to the present embodiment will be described.

First Embodiment

[Production Method of Ni-Based Alloy]

The method for producing a Ni-based alloy according to the present embodiment includes a casting step and a segregation reducing step. Hereinafter, each step will be described.

[Casting Step]

In the casting step, a liquid alloy of Ni-based alloy starting material is melted, and the liquid alloy is cast to produce a Ni-based alloy starting material having the following chemical composition.

[Chemical Composition]

The chemical composition of the Ni-based alloy starting material contains the following elements. Hereinafter, "%" concerning an element means, unless otherwise stated, mass %. Note that the chemical composition of a Ni-based alloy which is produced by the production method of a Ni-based alloy of the present embodiment is the same as the chemical composition of the Ni-based alloy starting material.

C: 0.100% or less

Carbon (c) is unavoidably contained. That is, the C content is more than 0%. When the C content is too high, carbides typified by Cr carbide precipitate at grain boundaries as a result of long-time use at a high temperature. In this case, the corrosion resistance of the Ni-based alloy will deteriorate. Precipitation of carbides at grain boundaries further deteriorates mechanical properties such as toughness of the Ni-based alloy. Therefore, the C content is 0.100% or less. The upper limit of the C content is preferably 0.070%, more preferably 0.050%, further preferably 0.030%, further preferably 0.025%, and further preferably 0.023%. The C content is preferably as low as possible. However, extreme reduction of the C content will increase the production cost. Therefore, the lower limit of the C content is preferably 0.001%, more preferably 0.005%, and further preferably 0.010%.

Si: 0.50% or less

Silicon (Si) is unavoidably contained. That is, the Si content is more than 0%. Si deoxidizes a Ni-based alloy. However, when the Si content is too high, Si combines with Ni or Cr, etc. to form inter metallic compounds, or to facilitate generation of intermetallic compounds such as a sigma phase (σ phase). As a result, the hot workability of the Ni-based alloy deteriorates. Therefore, the Si content is 0.50% or less. The upper limit of the Si content is preferably 0.40%, more preferably 0.30%, further preferably 0.25%, further preferably 0.20%, and further preferably 0.19%. The lower limit of the Si content to effectively achieve the above-described deoxidization effects is preferably 0.01%, more preferably 0.02%, and further preferably 0.04%.

Mn: 0.50% or less

Manganese (Mn) is unavoidably contained. That is, the Mn content is more than 0%. Mn deoxidizes a Ni-based alloy. Mn further immobilizes S, which is an impurity, as Mn sulfide, thereby improving the hot workability of the Ni-based alloy. However, when the Mn content is too high, formation of oxide film of spinel type is facilitated during use in a high-temperature corrosion environment, resulting in deterioration of oxidation resistance at high temperatures. When the Mn content is too high, further, the hot workability of the Ni-based alloy deteriorates. Therefore, the Mn content is 0.50% or less. The upper limit of the Mn content is preferably 0.40%, more preferably 0.30%, and further preferably 0.23%. The lower limit of the Mn content to effectively improve hot workability is preferably 0.01%, more preferably 0.02%, further preferably 0.04%, further preferably 0.08%, and further preferably 0.12%.

P: 0.015% or less

Phosphorus (P) is an impurity. The P content may be 0%. P deteriorates the toughness of a Ni-based alloy. Therefore, the P content is (0% or more, and) 0.015% or less. The upper limit of the P content is preferably 0.013%, more preferably 0.012%, and further preferably 0.010%. The P content is preferably as low as possible. However, extreme reduction of the P content will increase the production cost. Therefore, the lower limit of the P content is preferably 0.001%, more preferably 0.002%, and further preferably 0.004%.

S: 0.0150% or less

Sulfur (S) is an impurity which is unavoidably contained. That is, the S content is more than 0%. S deteriorates the hot workability of a Ni-based alloy. Therefore, the S content is 0.0150% or less. The upper limit of the S content is preferably 0.0100%, more preferably 0.0080%, further preferably 0.0050%, further preferably 0.0020%, further preferably 0.0015%, further preferably 0.0010%, and further preferably 0.0007%. The S content is preferably as low as possible. However, extreme reduction of the S content will increase the production cost. Therefore, the lower limit of the S content in view point of production cost is preferably 0.0001%, and more preferably 0.0002%.

Cr: 20.0 to 23.0%

Chromium (Cr) improves the corrosion resistance such as oxidation resistance, water vapor oxidation resistance, and high-temperature corrosion resistance of a Ni-based alloy. Further, Cr combines with Nb to form an intermetallic compound and precipitate at grain boundaries, thereby improving the creep strength of a Ni-based alloy. When the Cr content is too low, the above-described effects cannot be achieved sufficiently. On the other hand, when the Cr content is too high, carbide of $M_{23}C_6$ type precipitates in a large amount, and thereby the corrosion resistance rather deteriorates. Therefore, the Cr content is 20.0 to 23.0%. The lower limit of the Cr content is preferably 20.5%, more preferably 21.0%, and further preferably 21.2%. The upper limit of the Cr content is preferably 22.9%, more preferably 22.5%, further preferably 22.3%, and further preferably 22.0%.

Mo: 8.0 to 10.0%

Molybdenum (Mo) improves the corrosion resistance of a Ni-based alloy in high-temperature corrosion environments. Further, Mo dissolves into the matrix, and improves the creep strength of a Ni-based alloy by solid solution strengthening. As a result, the strength of the Ni-based alloy in a high-temperature corrosion environment increases. On the other hand, when the Mo content is too high, the hot workability deteriorates. Therefore, the Mo content is 8.0 to 10.0%. The lower limit of the Mo content is preferably 8.1%, more preferably 8.2%, further preferably 8.3%, further preferably 8.4%, and further preferably 8.5%. The upper limit of the Mo content is preferably 9.9%, more preferably 9.5%, further preferably 9.2%, further preferably 9.0%, and further preferably 8.8%.

One or more elements selected from the group consisting of Nb and Ta: 3.150 to 4.150%

Niobium (Nb) and Tantalum (Ta) both facilitate generation of intermetallic compound, thereby contributing to precipitation strengthening at grain boundaries and within grains. As a result, the creep strength increases. When the total content of one or more elements selected from the group consisting of Nb and Ta is too low, the above-described effects cannot be sufficiently achieved. On the other hand, when the total content of one or more elements selected from the group consisting of Nb and Ta is too high, precipitates become coarse, thereby decreasing the creep strength. Therefore, the total content of one or more elements selected from the group consisting of Nb and Ta is 3.150 to 4.150%. The lower limit of the total content of one or more elements selected from the group consisting of Nb and Ta is preferably 3.200%, more preferably 3.210%, and further preferably 3.220%. The upper limit of the total content of one or more elements selected from the group consisting of Nb and Ta is preferably 4.120%, more preferably 4.000%, further preferably 3.800%, further preferably 3.500%, and further preferably 3.450%. Note that only Nb may be contained, and Ta may not be contained. Moreover, only Ta may be contained, and Nb may not be contained. Both Nb and Ta may be contained. When only Nb out of Nb and Ta is contained, the above-described total content (3.150 to 4.150%) means the content of Nb. When only Ta out of Nb and Ta is contained, the above-described total content (3.150 to 4.150%) means the content of Ta.

Ti: 0.05 to 0.40%

Titanium (Ti), along with Si, Mn, and Al, deoxidizes a Ni-based alloy. Further, Ti along with Al forms a gamma prime phase (γ' phase), thereby improving the creep strength of a Ni-based alloy under a high-temperature corrosive environment. When the Ti content is too low, the above-described effects cannot be sufficiently achieved. On the other hand, when the Ti content is too high, a large amount of carbide and/or oxide is generated, thus deteriorating the hot workability and the creep strength of a Ni-based alloy. Therefore, the Ti content is 0.05 to 0.40%. The lower limit of the Ti content is preferably 0.08%, more preferably 0.10%, further preferably 0.13%, and further preferably 0.15%. The upper limit of the Ti content is preferably 0.35%, more preferably 0.30%, further preferably 0.25%, and further preferably 0.22%.

Al: 0.05 to 0.40%

Aluminum (Al), along with Si, Mn, and Ti, deoxidizes a Ni-based alloy. Further, Al, along with Ti, forms a gamma prime phase (γ' phase), thereby improving the creep strength of the Ni-based alloy under a high-temperature corrosive environment. When the Al content is too low, the above-described effects cannot be sufficiently achieved. On the other hand, when the Al content is too high, oxide-based inclusions are generated in a large amount, thus deteriorating the hot workability and the creep strength of a Ni-based alloy. Therefore, the Al content is 0.05 to 0.40%. The lower limit of the Al content is preferably 0.06%, more preferably 0.07%, and further preferably 0.08%. The upper limit of the Al content is preferably 0.35%, more preferably 0.32%, further preferably 0.30%, and further preferably 0.27%. Note that the Al content herein means the content of sol. Al (acid soluble Al).

Fe: 0.05 to 5.00%

Iron (Fe) substitutes for Ni. Specifically, Fe improves the hot workability of a Ni-based alloy. Further, Fe precipitates Laves phase at grain boundaries, thereby strengthening the grain boundaries. When the Fe content is too low, the above-described effects cannot be sufficiently achieved. On the other hand, when the Fe content is too high, the corrosion resistance of a Ni-based alloy deteriorates. Therefore, the Fe content is 0.05 to 5.00%. The lower limit of the Fe content is preferably 0.10%, more preferably 0.50%, further preferably 1.00%, further preferably 2.00%, and further preferably 2.50%. The upper limit of the Fe content is preferably 4.70%, more preferably 4.50%, further preferably 4.00%, and further preferably 3.90%.

N: 0.100% or less

Nitrogen (N) is unavoidably contained. That is, the N content is more than 0%. N stabilizes the austenite in a Ni-based alloy. Further, N increases the creep strength of a Ni-based alloy. However, when the N content is too high, the hot workability of the Ni-based alloy deteriorates. Therefore, the N content is 0.100% or less. The upper limit of the N content is preferably 0.080%, more preferably 0.050%, further preferably 0.030%, and further preferably 0.025%. Extreme reduction of the N content will increase the production cost. Therefore, in viewpoint of production cost, the lower limit of the N content is preferably 0.001%, more preferably 0.002%, and further preferably 0.005%.

O: 0.1000% or less

Oxygen (O) is an impurity. The O content may be 0%. O generates oxides, thereby deteriorates the hot workability of a Ni-based alloy. Therefore, the O content is (0% or more, and) 0.1000% or less. The upper limit of the O content is preferably 0.0800%, more preferably 0.0500%, further preferably 0.0300%, and further preferably 0.0150%. The O content is preferably as low as possible. However, extreme reduction of the O content will increase the production cost. Therefore, in viewpoint of production cost, the lower limit of the O content is preferably 0.0001%, more preferably 0.0002%, and further preferably 0.0005%.

The balance of the Ni-based alloy starting material according to the present invention is nickel (Ni) and impurities. Note that an impurity herein means an element which is mixed in from ores and scraps as the raw material, or from the environment of production process, etc. when the Ni-based alloy is industrially produced.

Note that Ni stabilizes austenite in the structure of a Ni-based alloy and improves the corrosion resistance of the Ni-based alloy. As described above, the balance other than the above-described elements of the chemical composition is Ni and impurities. The lower limit of the Ni content is preferably 58.0%, more preferably 59.0%, and further preferably 60.0%.

The Ni-based alloy starting material of the present embodiment may further contain, in place of part of Ni, one or more elements selected from the group consisting of Co and Cu. Both of Co and Cu increase the high-temperature strength of a Ni-based alloy.

Co: 0 to 1.00%

Cobalt (Co) is an optional element. That is, the Co content may be 0%. When contained, Co increases the high-temperature strength of a Ni-based alloy. When Co is contained even in a small amount, the above-described effects can be achieved to some extent. However, when the Co content is too high, the hot workability of a Ni-based alloy deteriorates. Therefore, the Co content is 0 to 1.00%. The upper limit of the Co content is preferably 0.90%, more preferably 0.80%, further preferably 0.70%, and further preferably 0.60%. The lower limit of the Co content is preferably 0.01%, more preferably 0.10%, further preferably 0.20%, and further preferably 0.30%.

Cu: 0 to 0.50%

Copper (Cu) is an optional element. That is, the Cu content may be 0%. When contained, Cu precipitates to increase the high-temperature strength of a Ni-based alloy. When Cu is contained even in a small amount, the above-described effects can be achieved to some extent. However, when the Cu content is too high, the hot workability of a Ni-based alloy deteriorates. Therefore, the Cu content is 0 to 0.50%. The upper limit of the Cu content is preferably 0.45%, more preferably 0.40%, further preferably 0.30%, further preferably 0.20%, and further preferably 0.15%. The lower limit of the Cu content is preferably 0.01%, more preferably 0.02%, and further preferably 0.05%.

The Ni-base alloy starting material of the present embodiment may further contain, in place of part of Ni, one or more elements selected from the group consisting of Ca, Nd, and B.

At least one or more elements selected from the group consisting of Ca, Nd, and B: 0 to 0.5000% in total content All of calcium (Ca), neodymium (Nd), and boron (B) are optional elements, and may not be contained. That is, the Ca content may be 0%, the Nd content may be 0%, and the B content may be 0%. When at least one or more elements selected from the group consisting of Ca, Nd, and B are contained, all of these elements improve the hot workability of a Ni-based alloy. Since it is satisfactory that at least one or more elements selected from the group consisting of Ca, Nd, and B are contained, for example, only Ca may be contained, only Nd may be contained, and only B may be contained. Ca and Nd may be contained, Ca and B may be contained, and Nd and B may be contained. Ca, Nd, and B may be contained. When at least one or more elements selected from the group consisting of Ca, Nd, and B are contained even in a small amount, the above-described effects can be achieved to some extent. However, Ca, Nd, and B are likely to be absorbed into slag while the liquid alloy is melted, and are not likely to remain in the Ni-based alloy starting material. For that reason, the total content of Ca, Nd, and B is not likely to be more than 0.5000%. Therefore, the total content of at least one or more elements selected from the group consisting of Ca, Nd, and B is 0 to 0.5000%. The upper limit of the total content of at least one or more elements selected from the group consisting of Ca, Nd, and B is preferably 0.4500%, and more preferably 0.4200%. The lower limit of the total content of at least one or more elements selected from the group consisting of Ca, Nd, and B is preferably 0.0001%, more preferably 0.0003%, and further preferably 0.0005%.

A liquid alloy is melted such that the chemical composition of the Ni-based alloy starting material has the above-described chemical composition. The liquid alloy may be melted by a well-known method. The liquid alloy is produced by, for example, electric furnace melting. The liquid alloy may be melted by vacuum melting. In viewpoint of production cost, the liquid alloy is preferably melted by electric furnace melting.

The melted liquid alloy is used to produce a Ni-based alloy starting material having the above-described chemical composition by a casting method. The Ni-base alloy starting material may be an ingot produced by an ingot-making process, or a cast piece (slab or bloom) produced by a continuous casting process.

A solidification cooling rate $V_R$ from the state of a liquid alloy until the solidified state as a Ni-based alloy starting material in the casting step can be calculated by measuring dendrite secondary arm spacing $D_{II}$ of the Ni-based alloy starting material after casting step and before the segregation reducing step. The dendrite secondary arm spacing $D_{II}$ can be measured by the following method. A sample is collected at a W/4 depth position of a section perpendicular to the longitudinal direction (cross section) at a central position in the longitudinal direction of the Ni-based alloy starting material. After mirror polishing is performed on a surface parallel with the above-described cross section out of the surfaces of the sample, etching by aqua regia is performed. The etched surface is observed by an optical microscope of 400 times magnification to generate a photographic image of an observation field of view of 200 μm×200 μm. Using the obtained photographic image, dendrite secondary arm spacing (μm) at arbitrary 20 locations in the observation field of view are measured. An average of the measured dendrite secondary arm spacing is defined as a dendrite secondary arm spacing $D_{II}$ (μm).

A solidification cooling rate $V_R$ (° C./min) is determined by substituting the determined dendrite secondary arm spacing $D_{II}$ for Formula (A).

$$D_{II}=182V_R^{-0.294} \quad \text{(A)}$$

[Segregation Reducing Step]

In the segregation reducing step, Mo segregation is reduced for the Ni-base alloy starting material produced in the casting step. Specifically, for the Ni-based alloy starting material produced in the casting step:

(I) heat treatment, or (II) heat treatment, and complex treatment after the heat treatment are performed.

In the present description, "complex treatment" means a series of treatments in which hot working is performed, and further, heat treatment is performed after the hot working. In other words, "complex treatment" means a combined treatment of hot working at one time and heat treatment at one time after the hot working. Heat treatment at one time means a treatment in which an object is inserted into a reheating furnace or a soaking pit and is retained at a predetermined holding temperature for a predetermined holding time, thereafter being extracted. Hot working at one time means a treatment starting from hot working on a Ni-based alloy starting material heated to 1000 to 1300° C. ending in the hot working. Hot working means, for example, hot extrusion, hot forging, and hot rolling.

In the segregation reducing step, the heat treatment may be performed only at one time without performing the complex treatment, or the complex treatment may be performed only at one time without performing the heat treatment. Moreover, the complex treatment may be performed repeatedly at multiple times. The complex treatment at one or more times may be performed after the heat treatment at one or more times. The heat treatment at one or more times may be performed after the complex treatment at one or more times. In short, in the segregation reducing step, the heat treatment at least one time, or the heat treatment at least one time and the complex treatment at least one time may be performed.

After heat treatment, the complex treatment may be performed in the same status, or after heat treatment, the Ni-based alloy starting material may be once cooled, and the heat treatment may be performed again, thereafter performing the complex treatment (that is, in this case, heat treatment, heat treatment, and complex treatment are performed in this order). Moreover, the complex treatment may be performed after the heat treatment, and thereafter, the complex treatment may be performed (in this case, the heat treatment, the complex treatment, and the complex treatment are performed in this order). The heat treatment and the complex treatment may be appropriately combined. For example, the performing order may be in the order of heat treatment, complex treatment, and heat treatment, or in the order of heat treatment, complex treatment, heat treatment, and complex treatment. Hereinafter, the hot working during the heat treatment and the complex treatment will be described.

[Heat Treatment]

In the n-th heat treatment, the Ni-based alloy starting material produced by the casting step is retained at a holding temperature $T_n$ (° C.) for a holding time $t_n$ (hr). Where, n is 1 to N (N is a natural number), the holding temperature $T_n$ means the holding temperature (° C.) of the n-th heat treatment (including the heat treatment of the above-described (I) and the heat treatment of the above-described (II)), the holding time $t_n$ means the holding time (hr) of the n-th heat treatment. N is a total number of the heat treatment of the above-described (I) and the heat treatment of the above-described (II).

When the holding temperature $T_n$ is too low, the diffusion distance σ of Mo cannot be increased, and Mo is not likely to diffuse during the heat treatment. On the other hand, when the holding temperature $T_n$ is too high, part of the Ni-based alloy starting material may possibly be remelted. Therefore, although the holding temperature $T_n$ is not particularly limited, the holding temperature $T_n$ is preferably 1000 to 1300° C. The heat treatment can be sufficiently performed by a well-known reheating furnace or a soaking pit.

[Hot Working]

The hot working may be, as described above, hot extrusion, hot forging, and hot rolling. The types of hot working will not be particularly limited. In the production method of the present embodiment, when hot working is performed, the above-described heat treatment is performed after the hot working (complex treatment). Owing to the hot working, the Mo inter-segregation distance Ds in the Ni-based alloy starting material has been decreased. For that reason, in the heat treatment after the hot working, Mo is more likely to diffuse, thereby reducing the holding time to which is needed for reducing Mo segregation. Note that in the segregation reducing step, when the complex treatment is performed without the heat treatment being performed in a preceding stage, the Ni-based alloy starting material is heated to 1000 to 1300° C. in a reheating furnace of a soaking pit, and is thereafter subjected to hot working.

[Formula (1)]

As described above, in the segregation reducing step, heat treatment at one or more times, or heat treatment at one or more times and complex treatment at one or more times are performed. In this occasion, the holding temperature $T_n$ (° C.), the holding time $t_n$ (hr), and the area reduction ratio $Rd_{n-1}$(%) are adjusted such that Formula (1) is satisfied.

[Expression 7]

$$V_R^{-0.294} \leq 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} \quad (1)$$

Note that when the heat treatment is performed only at one time, and the complex treatment is not performed in the segregation reducing step (that is, when n=1, and N=1), hot working will not be performed in the segregation reducing step. For that reason, the cumulative area reduction ratio $Rd_{n-1}=Rd_0$ will be 0(%). Therefore, based on the following Formula which is obtained by substituting $Rd_0=0$ for Formula (1), the solidification cooling rate $V_R$ (° C./min), the holding temperature $T_n$ (° C.), and the holding time $t_n$ (hr) are adjusted.

[Expression 8]

$$V_R^{-0.294} \leq 1.27 \times 10^3 \sum_{n=1}^{N} \sqrt{\exp\left(\frac{-2.89 \times 10^4}{T_n + 273}\right) \cdot t_n}$$

If the segregation reducing step (the heat treatment, or the heat treatment and the complex treatment) is performed so as to satisfy Formula (1), it is possible to produce a Ni-based alloy in which Mo segregation is suppressed. Note that after the segregation reducing step is performed, other steps such as a hot working step, a cold working step, and a cutting step may be performed.

[Ni-Based Alloy According to the Present Embodiment]

The shape of the Ni-based alloy according to the present embodiment will not be particularly limited. The Ni-based alloy produced by the above-described production method is, for example, a billet. The section (cross section) perpendicular to the longitudinal direction of the Ni-based alloy may be of a circular shape, a rectangular shape, or a polygonal shape. The Ni-based alloy may be a pipe, or a solid material.

The Ni-based alloy according to the present invention has a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less, O: 0.1000% or less, Co: 0 to 1.00%, Cu: 0 to 0.50%, one or more elements selected from the group consisting of Ca, Nd, and B: 0 to 0.5000%, and the balance being Ni and impurities. That is, the chemical composition of the Ni-based alloy of the present embodiment is the same as the chemical composition of the above-described Ni-based alloy starting material. Further in the Ni-based alloy of the present embodiment, in a section perpendicular to the longitudinal direction of the Ni-based alloy, an average concentration of Mo is 8.0% or more in mass %, a maximum value of Mo concentration is 11.0% or less in mass %, and further an area ratio of a region in which Mo concentration is less than 8.0% in mass % is less than 2.0%. In the Ni-based alloy according to the present embodiment, segregation of Mo is suppressed. Hereinafter, the Ni-based alloy of the present embodiment will be described. Note that the content (including a preferable upper limit and a preferable lower limit) of each element of the chemical composition and advantageous effects of the Ni-based alloy of the present embodiment are the same as the content (including a preferable upper limit and a preferable lower limit) of each element of the chemical composition and the advantageous effects of the Ni-based alloy starting material in the above-described production method of a Ni-based alloy.

[Suppression of Mo Segregation]

In the Ni-based alloy of the present embodiment, Mo segregation is suppressed. Specifically, in a section perpendicular to the longitudinal direction of the Ni-based alloy (hereinafter, referred to as a cross section), an average concentration of Mo is 8.0% or more in mass %, a maximum value of Mo concentration is 11.0% or less in mass %, and further an area fraction of a region in which Mo concentration is less than 8.0% in mass % is less than 2.0%.

The average concentration of Mo, the maximum value of Mo concentration, and the region in which the Mo concentration is less than 8.0% in mass % in a cross section of the Ni-based alloy are determined by the following method. Note that, in the present description, a region in which Mo concentration is less than 8.0% in mass % is also referred to as a "Mo low-concentration region".

A sample is collected from a cross section of Ni-based alloy. Specifically, when the Ni-based alloy is a solid material whose cross sectional shape is a rectangular shape, the long side of the cross section is defined as a width W. When it is a solid material (that is, bar blank) whose cross section is of a circular shape, the diameter is defined as a width W. When the Ni-based alloy is a solid material, a sample is collected from a W/4 depth position in the width W direction from a surface perpendicular to the width W direction (W/4 depth position). On the other hand, when the Ni-based alloy is a pipe, a sample is collected from a wall-thickness central position. Out of the surface of the sample, a surface (observation surface) corresponding to the cross section is mirror polished, and line analysis by an electron probe micro analyzer (EPMA) is performed with a beam diameter: 10 μm, a scanning length: 2000 μm, an irradiation time for one point: 3000 ms, and an irradiation pitch: 5 μm in any one field of view in the observation surface. In the scanning rage of 2000 μm in which the line analysis has been performed, an average value of multiple Mo concentrations measured at a 5 μm pitch, a maximum value of Mo concentration and a minimum value of Mo concentration of the multiple measured Mo concentrations are determined. Further, in the scanning length 2000 μm which is the measurement range, a total length of ranges in which measured points at which Mo concentration has turned out to be less than 8.0% are continuous (a range in which two or more points are continuous) is determined. The determined total length is defined as total length of Mo low-concentration region (μm).

The determined total length of Mo low-concentration region is used to define a fraction of Mo low-concentration region (%) according to the following formula.

Fraction of Mo low-concentration region=total length of Mo low-concentration region (μm)/scanning length(=2000 μm)×100

The fraction of Mo low-concentration region determined by the above described formula is defined as an "area fraction of region in which Mo concentration is less than 8.0% in mass %". More specifically, upon performing line analysis by EPMA with a beam diameter: 10 μm, a scanning length: 2000 μm, an irradiation time per one point: 3000 ms, and an irradiation pitch: 5 μm, in a cross section of the Ni-based alloy, the average concentration of Mo obtained at a pitch of 5 μm in a scanning length of 2000 μm is 8.0% or more in mass %; the maximum value of Mo concentration is 11.0% or less in mass %; and when a total length of ranges in which measured points, at which the Mo concentration is less than 8.0%, in a scanning length of 2000 μm, are continuous (ranges in which two or more points are continuous) is defined as an Mo low-concentration region, the fraction of the total length of Mo low-concentration region with respect to the scanning length is less than 2.0%.

In the Ni-based alloy of the present embodiment, an average value of Mo concentration obtained by the above-described measurement is 8.0% or more in mass %, and a maximum value of Mo concentration is 11.0% or less in mass %. Further, ratio of region in which Mo concentration is less than 8.0% in mass %, that is, the fraction of Mo low-concentration region is less than 2.0%.

As described so far, in the Ni-based alloy of the present embodiment, Mo segregation is suppressed. As a result, the corrosion resistance of the Ni-based alloy is improved. Specifically, it is possible to suppress intergranular corrosion and stress corrosion cracking, in the following way.

[Reduction of Intergranular Corrosion]

In the Ni-based alloy according to the present embodiment, when a corrosion test specified by ASTM G28 Method A is performed, a corrosion rate is 0.075 mm/month or less. The corrosion test conforming to ASTM G28 Method A is performed by the following method. A test specimen is collected from any position of the Ni-based alloy. The size of the test specimen is, for example, 40 mm×10 mm×3 mm. The weight of the test specimen before starting corrosion test is measured. After the measurement, the test specimen is immersed in a solution (50% sulfuric acid/ferric sulfate solution), in which 25 g of ferric sulfate is added to 600 mL of sulfuric acid solution of 50% in mass %, for 120 hours. After elapse of 120 hours, the weight of the test specimen after testing is measured. Based on the change in the weight of the measured test specimen, specimen loss due to testing is determined. By use of the density of the test specimen, the specimen loss due to testing is converted into an amount of volume decrease. A corrosion depth is determined by dividing the amount of volume decrease by the surface area of the test specimen. A corrosion rate (mm/month) is determined by dividing the corrosion depth by the test time.

In the Ni-based alloy of the present embodiment, the corrosion rate is 0.075 mm/month or less, and thus intergranular corrosion is suppressed, thus exhibiting excellent corrosion resistance.

[Suppression of Stress Corrosion Cracking]

The Ni-based alloy of the present embodiment not only excels in intergranular corrosion resistance, but also is able to suppress stress corrosion cracking. Specifically, a slow-strain-rate tensile test specimen is collected from an arbitrary position of the Ni-based alloy. The length of the slow-strain-rate tensile test specimen is 80 mm, the length of a parallel part is 25.4 mm, and the diameter of the parallel part is 3.81 mm. The longitudinal direction of the slow-strain-rate tensile test specimen was made parallel with the longitudinal direction of the Ni-based alloy. The slow strain rate tensile test (SSRT) is performed at a strain rate of $4.0\times10^{-6}$ $S^{-1}$ while immersing the slow-strain-rate tensile test specimen in a water solution of 25% NaCl+0.5% $CH_3COOH$ of pH 2.8 to 3.1 and 232° C., which is saturated with 0.7 MPa of hydrogen sulfide, to cause the test specimen to be torn off. In the test specimen after the test, whether or not any sub-crack has occurred in a portion other than the torn-off part is visually confirmed. When any sub-crack has occurred, it is judged that stress corrosion cracking has occurred, and when no sub-crack is confirmed, it is judged that no stress corrosion cracking has occurred. In the Ni-based alloy produced by the present production method, no sub-crack is confirmed in the above-described slow strain rate tensile test, and thus stress corrosion cracking is suppressed. Therefore, the Ni-based alloy produced by the production method of the present embodiment has excellent corrosion resistance.

As so far described, in the Ni-based alloy produced by the production method of the present embodiment, the above-described chemical composition is contained, and further an average concentration of Mo is 8.0% or more in mass %, a maximum value of Mo concentration is 11.0% or less in mass %. Further, an area fraction of region (Mo low-concentration region) in which Mo concentration is less than 8.0% in mass % is less than 2.0%. Therefore, the Ni-base alloy of the present embodiment is excellent in corrosion resistance. Specifically, a corrosion rate obtained by the ASTM G28 Method A test is 0.075 mm/month or less, thus exhibiting excellent corrosion resistance (intergranular corrosion resistance). Further, in the SSRT test, no sub-crack has occurred in any region other than the torn-off part of the test specimen, thus exhibiting excellent corrosion resistance (specifically, SCC resistance).

[Production Method of Ni-Based Alloy of the Present Embodiment]

The production method of a Ni-base alloy of the present embodiment will not be particularly limited provided that a Ni-based alloy having the above-described configuration can be produced. However, the above-described production method of a Ni-based alloy is a suitable example for producing a Ni-base alloy of the present embodiment. Specifically, the production method of a Ni-base alloy of the present embodiment includes the above-described casting step and the above-described segregation reducing step. In the above-described casting step, liquid alloy is cast to produce a Ni-based alloy starting material having a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less, O: 0.1000% or less, Co: 0 to 1.00%, Cu: 0 to 0.50%, one or more elements selected from the group consisting of Ca, Nd, and B: 0 to 0.5000%, and the balance being Ni and impurities. Then, in the segregation reducing step, (I) heat treatment at one or more times, or (II) heat treatment at one or more times and complex treatment at one or more times are performed on the Ni-base alloy starting material produced by the casting step to satisfy Formula (1).

[Expression 9]

$$V_R^{-0.294} \leq 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} \quad (1)$$

By the above-described production method, a Ni-based alloy having a chemical composition consisting of: in mass %, C: 0.100% or less, Si: 0.50% or less, Mn: 0.50% or less, P: 0.015% or less, S: 0.0150% or less, Cr: 20.0 to 23.0%, Mo: 8.0 to 10.0%, one or more elements selected from the group consisting of Nb and Ta: 3.150 to 4.150%, Ti: 0.05 to 0.40%, Al: 0.05 to 0.40%, Fe: 0.05 to 5.00%, N: 0.100% or less, O: 0.1000% or less, Co: 0 to 1.00%, Cu: 0 to 0.50%, one or more elements selected from the group consisting of Ca, Nd, and B: 0 to 0.5000%, and the balance being Ni and impurities, wherein, in a section perpendicular to the longitudinal direction of the Ni-based alloy, an average concentration of Mo is 8.0% or more in mass %, a maximum value of Mo concentration is 11.0% or less in mass %, and further an area ratio of a region in which Mo concentration is less than 8.0% in mass % is less than 2.0% can be produced.

Figure 4:
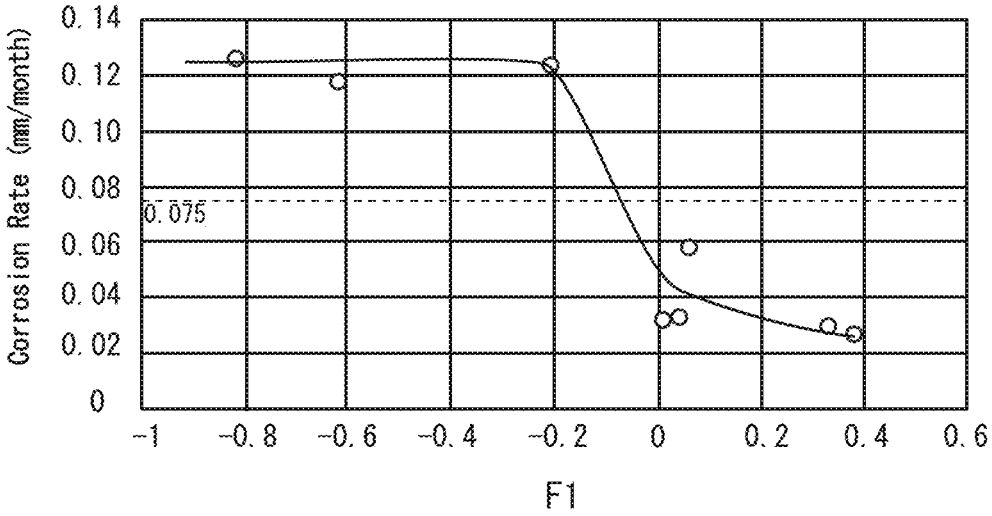
FIG. 4 is a diagram to show relationship between F1 (=the right hand side of Formula (1)−the left hand side of Formula (1)) and the corrosion rate in the Ni-based alloy having a chemical composition of the present invention.

FIG. 4 is a diagram to show relationship between F1 and the corrosion rate in a Ni-based alloy having the chemical composition of the present invention. Where, F1 is an expression obtained by subtracting the left hand side of Formula (1) from the right hand side of Formula (1), and is defined as follows.

[Expression 10]

$$F1 = 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} - V_R^{-0.294}$$

Referring to FIG. 4, when F1 is less than 0, that is the production condition in the segregation reducing step does not satisfy Formula (1), the corrosion rate is remarkably higher than 0.075 mm/month, and the corrosion rate will not vary significantly even when F1 value varies. In contrast to this, when F1 is 0 or more, that is, the production condition in the segregation reducing step satisfies Formula (1), the corrosion rate remarkably decreases to be 0.075 mm/month or less. Therefore, a Ni-base alloy produced in a production condition that satisfies Formula (1) has excellent corrosion resistance. Note that the production method of a Ni-based alloy of the present embodiment will not be particularly limited provided that a Ni-based alloy having the above-described configuration can be produced. The above-described production method using Formula (1) is a suitable example for producing a Ni-based alloy of the present embodiment.

[Preferable Form (1) of Ni-Based Alloy of First Embodiment]

It is known that in a Ni-based alloy, the finer the crystal grains, the more excellent the strength and toughness will be. Preferably, a Ni-based alloy of the present embodiment has a grain size number conforming to ASTM E112 of 0.0 or more. A grain size number of 0.0 or more indicates that solidification structure is dissolved and the microstructure is substantially crystallized in the Ni-based alloy. The grain size number is preferably 0.5 or more, and more preferably 1.0 or more. The upper limit of grain size number will not be particularly limited.

The measurement method of grain size number in a Ni-based alloy of the present embodiment is as follows. A Ni-based alloy is divided into 5 equal sections in the axial direction (longitudinal direction) and an axially central position of each section is identified. At the identified position of each section, four sample collection positions are identified at a pitch of 90° around the central axis of the Ni-based alloy. For example, when the Ni-based alloy is a pipe, sample collection positions are identified at a 90 degree pitch in the pipe circumferential direction. Samples are collected from the identified sample collection positions. When the Ni-based alloy is a pipe, a sample is collected from the wall-thickness central position of each of the identified sample collection positions. When the Ni-based alloy is a bar, or an alloy having a cross section of a rectangular shape, a sample is collected from a W/4 depth position in a selected sample collection position. It is supposed that the observation surface of sample is a section perpendicular to the axial direction of the Ni-based alloy, and the area of the observation surface is 40 $mm^2$.

According to the above-described method, four samples in each section, and 20 samples in all the sections are collected. Each observation surface of the collected samples is etched by using Glyceregia, Kalling's reagent, or Marble's reagent, etc. to cause grain boundaries in the surface to appear. The etched observation surface is observed to determine the grain size number in conformity with ASTM E112.

An average value of the grain size numbers determined in the 20 samples is defined as the grain size number conforming to ASTM E112 in the Ni-based alloy.

A Ni-based alloy, which is the Ni-based alloy of the present embodiment, and whose grain size number conforming to ASTM E112 is 0.0 or more, is produced, for example, by the following method.

In the production method of Ni-based alloy including the above-described casting step and segregation reducing step, a complex treatment is performed at least one time in the segregation reducing step. Then, in the complex treatment, hot working at an area reduction ratio of 35.0% or more is performed at least one time for the Ni-base alloy starting material which has been heated to 1000 to 1300° C. The hot working in this condition is referred to as "specific hot working". In the segregation reducing step, when the specific hot working is performed at least one time, the grain size number conforming to ASTM E112 will be 0.0 or more in the produced Ni-based alloy. Note that the area reduction ratio herein does not mean an cumulative area reduction ratio, but means an area reduction ratio in hot working at one time.

Figure 5A:
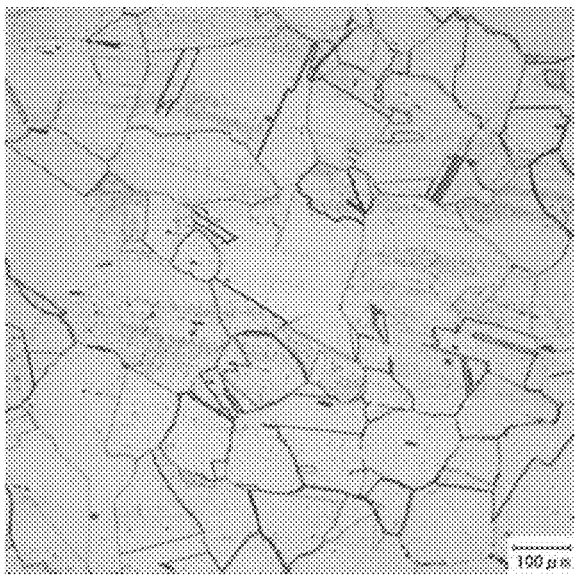
FIG. 5A is a microstructure observation image of a Ni-based alloy when hot working is performed one time at an area reduction ratio of 44.6% in a segregation reducing process.
Figure 5B:
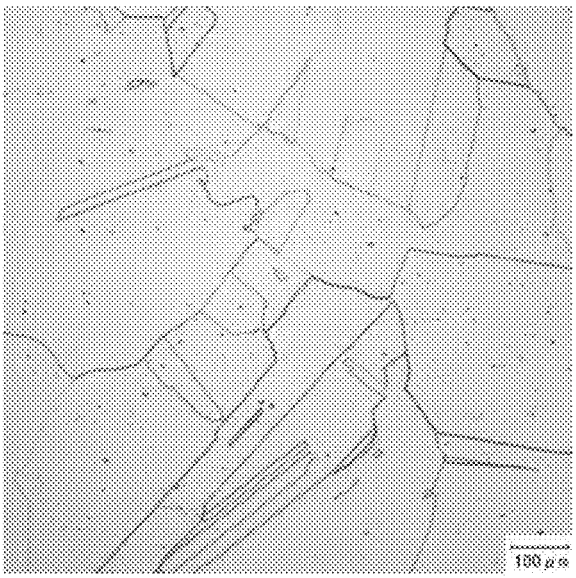
FIG. 5B is a microstructure observation image of a Ni-based alloy when hot working is conducted one time at an area reduction ratio of 31.3% in a segregation reducing step.

FIG. 5A is a microstructure observation image of a Ni-based alloy produced by performing hot working one time at an area reduction ratio of 44.6% for a Ni-based alloy starting material having the above-described chemical composition in the segregation reducing step. FIG. 5B is a microstructure observation image of a Ni-based alloy produced by performing hot working one time at an area reduction ratio of 31.3% for the Ni-based alloy starting material having the above-described chemical composition in the segregation reducing step. In FIG. 5A, the grain size number conforming to ASTM E112 was 2.0, that is, 0.0 or more. In contrast to this, in FIG. 5B, the grain size number conforming to ASTM E112 was −2.0, that is, less than 0.0. As described so far, in the segregation reducing step, by performing hot working at an area reduction ratio of 35.0% or more at least one time for a Ni-based alloy starting material having the above-described chemical composition, it is possible to produce a Ni-based alloy having a grain size number conforming to ASTM E112 of 0.0 or more. Note that the specific hot working may be performed multiple times.

[Preferable Form (2) of Ni-Based Alloy of First Embodiment]

Preferably, in the Ni-based alloy of the present embodiment, further, the total number of Nb carbonitride whose maximum length is 1 to 100 μm is $4.0\times10^{-2}$ $\mu m^2$ or less in the Ni-based alloy.

Where, "Nb carbonitride" herein is a concept including Nb carbide, Nb nitride, and Nb carbonitride, and means a precipitate in which a total content of Nb, C, and N is, in mass %, 90% or more. Moreover, the maximum length of Nb carbonitride means the maximum length of straight lines connecting arbitrary two points on the interface (boundary) between Nb carbonitride and the mother phase.

When the total number of coarse Nb carbonitride is $4.0\times10^{-2}/\mu m^2$ or less, Nb carbonitride is sufficiently dissolved into the matrix. For that reason, starting points of cracking during hot working decrease, and thus hot workability is further improved.

Figure 6:
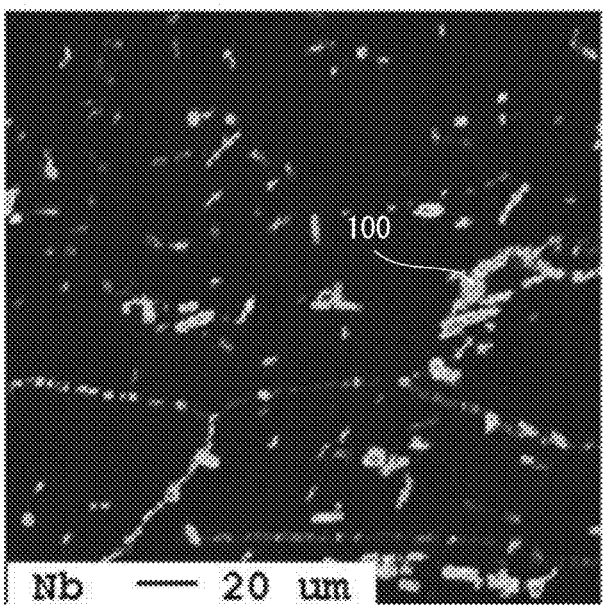
FIG. 6 is an EPMA image in a Ni-based alloy according to a second embodiment.

The total number of coarse Nb carbonitride can be determined by the following method. The Ni-based alloy is divided into 5 equal sections in the axial direction, and an axially central position of each section is identified. In each section, sample collection positions are identified at 90 degree pitch in the pipe circumferential direction at the axially central position. Samples are collected from the identified sample collection positions. When Ni-based alloy is a pipe, a sample is collected from the wall-thickness central position of each of the identified sample collection positions. When the Ni-based alloy is a bar, or an alloy having a cross section of a rectangular shape, a sample is collected from a W/4 depth position at an identified sample collection position. The observation surface of sample is a section perpendicular to the axial direction of the Ni-based alloy. In any one field of view (400 μm×400 μm) in each observation surface (of a total of 20), Nb carbonitride is identified by EPMA (Electron Probe Micro Analyzer). Specifically, a precipitate in which a total content of Nb, C, and N is 90% or more is identified by plane analysis of EPMA, and the identified precipitate is defined as Nb carbonitride. FIG. 6 is an EPMA image in one example of the above-described one field of view. A precipitate 100 which is displayed in white in FIG. 6 is Nb carbonitride. A maximum length of the identified Nb carbonitride is measured. As described so far, among straight lines connecting arbitrary two points on the interface between Nb carbonitride and the mother phase, the value of the longest straight line is defined as the maximum length of the Nb carbonitride. After measuring the maximum length of each Nb carbonitride, Nb carbonitride whose maximum length is 1 to 100 μm (coarse Nb carbonitride) is identified, and a total number of coarse Nb carbonitride in all the 20 fields of view is determined. Based on the obtained total number, a total number of coarse Nb carbonitride ($1/\mu m^2$) is determined.

A Ni-based alloy, which is the above-described Ni-based alloy, and in which a total number of Nb carbonitride whose maximum length is 1 to 100 μm is $4.0\times10^{-2}/\mu m^2$ or less can be produced by the following production method.

In a production method of a Ni-based alloy, including the above-described casting step and the segregation reducing step, heat treatment in which the holding temperature is 1000 to 1300° C., and the holding time is 1.0 hour or more is performed at least one time in the segregation reducing step. The heat treatment in this condition is referred to as "specific heat treatment". When the specific heat treatment is performed at least one time in the segregation reducing step, a total number of Nb carbonitride whose maximum length is 1 to 100 μm will be $4.0\times10^{-2}/\mu m^2$ or less. Note that the specific heat treatment may be performed multiple times.

[Preferable Form (3) of Ni-Based Alloy of First Embodiment]

The above-described Ni-based alloy may further have a grain size number conforming to ASTM E112 of 0.0 or more, and a total number of Nb carbonitride whose maximum length is 1 to 100 μm will be $4.0\times10^{-2}/\mu m^2$ or less in the Ni-based alloy.

In this case, preferably, in the above-described segregation reducing step, hot working at an area reduction ratio of 35.0% or more is performed at least one time for the Ni-base alloy starting material which has been heated to 1000 to 1300° C., and also in the above-described segregation reducing step, heat treatment in which the holding temperature is 1000 to 1300° C., and the holding time is 1.0 hour or more is performed at least one time. That is, in the segregation reducing step, the specific hot working is performed at least one time, and the specific heat treatment is performed at least one time.

Second Embodiment

Preferably, the above-described Ni-based alloy further contains one or more elements selected from the group consisting of Ca, Nd, and B by a content to satisfy Formula (2):

$$(Ca+Nd+B)/S\geq2.0 \quad (2)$$

where, each symbol of element in Formula (2) is substituted by a content in atomic % (at %) of a corresponding element.

All of calcium (Ca), neodymium (Nd), and boron (B) improve hot workability of a Ni-based alloy as described above. Definition is made as F2=(Ca+Nd+B)/S. F2 is an index of hot workability. When a total content F2 of one or more elements selected from the group consisting of Ca, Nd, and B is 2.0 or more, that is, F2 satisfies Formula (2), further excellent hot workability can be achieved in the Ni-based alloy of the above-described chemical composition. Specifically, reduction (reduction area after fraction) when tensile test is performed at a strain rate of 10/sec, at 900° C. in the atmosphere will be 35.0% or more.

Figure 7:
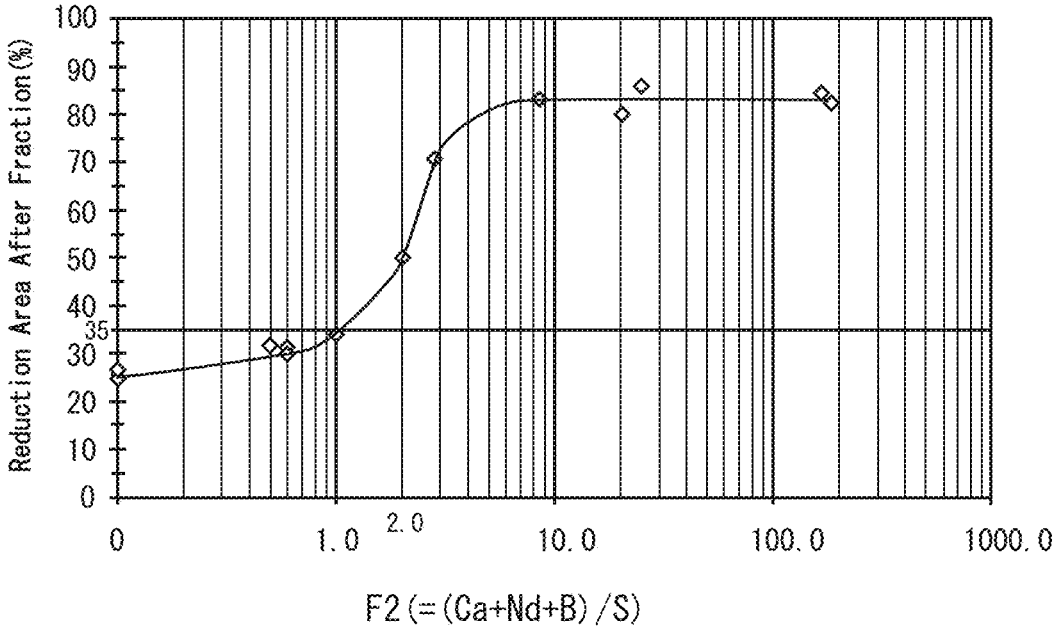
FIG. 7 is a diagram to show relationship between F2=(Ca+Nd+B)/S in a Ni-based alloy and reduction area after fraction (%) when a tensile test is conducted at a strain rate of 10/sec at a temperature of 900° C. in the atmosphere.

FIG. 7 is a diagram to show relationship between reduction area after fraction (%), which is obtained when tensile test is performed at a strain rate of 10/sec at 900° C. in the atmosphere for the Ni-based alloy of the present embodiment, and F2. FIG. 7 is obtained by a test shown in Example 2 to be described below. Referring to FIG. 7, until F2 became 1.0, the reduction area after fraction at 900° C. did not vary significantly even when F2 increased. On the other hand, when F2 became more than 1.0, the reduction area after fraction at 900° C. rapidly increased as F2 increased, and became more than 35.0% when F2 was 2.0, reaching about 50.0%. Thereafter, although the reduction area after fraction further increased as F2 increased, the reduction area after fraction became substantially constant at about 80.0% when F2 was 8.0 or more. That is, the curve of FIG. 7 had an inflection point in the vicinity of F2=1.0 to 2.0. From the result described so far, if F2 is 2.0 or more, it is possible to obtain a sufficient reduction area after fraction (35.% or more) at 900° C. The lower limit of F2 is preferably 2.5, more preferably 3.0, and further preferably 3.5.

Note that the upper limit of the total content (mass %) of Ca, Nd, and B in a Ni-based alloy is 0.5000% as in the first embodiment.

[Production Method of Ni-Based Alloy of Second Embodiment]

The production method of a Ni-base alloy of the second embodiment described above will not be particularly limited provided that a Ni-based alloy having the above-described configuration can be produced. Preferably, the production method of a Ni-based alloy of the second embodiment is the same as the production method of a Ni-based alloy of the first embodiment.

Specifically, the production method of a Ni-based alloy of the second embodiment includes a casting step and a segregation reducing step. In the casting step, a liquid alloy is cast to produce a Ni-based alloy starting material which has the above-described chemical composition and in which F2 satisfies Formula (2).

In the segregation reducing step, (I) heat treatment, or (II) heat treatment and complex treatment are performed on the Ni-based alloy starting material produced in the casting step. In the segregation reducing step, the heat treatment may be performed only one time, or the complex treatment may be performed only one time. Moreover, the complex treatment may be performed multiple times repeatedly. The complex treatment may be performed after the heat treatment.

As described so far, in the segregation reducing step, the heat treatment, or the heat treatment and the complex treatment are performed. In this occasion, the holding temperature $T_n$ (° C.), the holding time $t_n$ (hr), and the area reduction ratio $Rd_{n-1}$(%) are adjusted such that the solidification cooling rate $V_R$ in the casting step satisfies Formula (1).

[Expression 11]

$$V_R^{-0.294} \leq 1.27 \times 10^3 \sum_{n=1}^{N} \sqrt{\left(1 - \frac{Rd_{n-1}}{100}\right)^{-1} \cdot \exp\left(\frac{-2.89 \times 10^4}{T_n + 273}\right) \cdot t_n} \quad (1)$$

Note that when the heat treatment is performed only one time in the segregation reducing step, the area reduction ratio $R_{d0}$ is 0(%) since hot working is not performed. Therefore, based on a formula obtained by substituting $R_{d0}$=0% for Formula (1), the solidification cooling rate $V_R$ (° C./min), the holding temperature $T_n$ (° C.), and the holding time $t_n$ (hr) are adjusted.

[Expression 12]

$$V_R^{-0.294} \leq 1.27 \times 10^3 \sum_{n=1}^{N} \sqrt{\exp\left(\frac{-2.89 \times 10^4}{T_n + 273}\right) \cdot t_n}$$

Performing the segregation reducing step (heat treatment, or heat treatment and complex treatment) so as to satisfy Formula (1) for the Ni-based alloy starting material having the chemical composition that satisfies Formula (2) will make it possible to produce a Ni-based alloy of the second embodiment. Note that after the segregation reducing step is performed, further, other steps such as a hot working step, a cold working step, and a cutting step may be performed.

Note that the production method of a Ni-based alloy of the second embodiment does not perform a so-called secondary melting, in which after the Ni-based alloy starting material is produced in the casting step, the Ni-based alloy starting material is remelted. That is, in the present production method, it is preferable to perform the segregation reducing step without performing the secondary melting in which the Ni-based alloy produced by the casting step is remelted after the casting step.

In the Ni-based alloy of the second embodiment, Ca, Nd, and B, etc. generally combine with S in a steel material to form sulfide, and improve hot workability by reducing solid-solution S concentration in the Ni-based alloy (particularly, at grain boundaries). However, if the secondary melting is performed on the Ni-based alloy starting material that contains these elements, Ca, Nd, and B are discharged from the Ni-based alloy starting material to the outside at the time of secondary melting. For example, if electro slag remelting (ESR) is applied as the secondary melting, Ca, Nd, and B are taken into a molten slag when the Ni-based alloy starting material melts. As a result, Ca, Nd, and B are discharged from the Ni-based alloy starting material so that the chemical composition of the Ni-based alloy starting material after the secondary melting will not satisfy Formula (2). Similarly, if the vacuum arc remelting (VAR) is applied as the secondary melting, Ca, Nd, and B, which are effective elements to improve hot workability, will be caused to float to be separated by CO bubbles generated at the time of melting of the Ni-based alloy starting material. As a result, Ca, Nd, and B are discharged from the Ni-based alloy starting material, and the chemical composition of the Ni-based alloy starting material produced after the secondary melting will not satisfy Formula (2). In contrast to this, in the present production method, as described above, the Ni-based alloy starting material is produced by primary melting alone without performing the secondary melting (omitting the secondary melting). For that reason, in the Ni-based alloy, it is possible to maintain one or more elements of Ca, Nd, and B in a content that satisfies Formula (2), thus improving hot workability. Further, since the above-described segregation reducing step is performed on the Ni-based alloy starting material, it is possible to suppress Mo segregation.

[Preferable Form (1) of Ni-Based Alloy of Second Embodiment]

As in the first embodiment, preferably, the grain size number conforming to ASTM E112 is 0.0 or more in the Ni-based alloy of the second embodiment.

For obtaining a grain size number of 0.0 or more in a Ni-based alloy, preferably, hot working (specific hot working) at an area reduction ratio of 35.0% or more is performed at least one time for the Ni-based alloy starting material which has been heated to 1000 to 1300° C. in the above-described segregation reducing step. Performing the specific hot working at least one time in the segregation reducing step will result in that the grain size number conforming to ASTM E112 will be 0.0 or more in the produced Ni-based alloy. Note that, the specific hot working may be performed multiple times.

[Preferable Form (2) of Ni-Based Alloy of Second Embodiment]

As in the first embodiment, preferably, in the Ni-based alloy of the second embodiment, a total number of Nb carbonitride whose maximum length is 1 to 100 μm is $4.0\times10^{-2}/\mu m^2$ or less in the Ni-based alloy. In this case, hot workability is further improved.

When making the total number of Nb carbonitride whose maximum length is 1 to 100 μm is $4.0\times10^{-2}/\mu m^2$ or less in the Ni-based alloy, preferably, heat treatment (specific heat treatment) in which the holding temperature is 1000 to 1300° C., and the holding time is 1.0 hour or more is performed at least one time in the segregation reducing step. Performing the specific heat treatment at least one time will result in that the total number of Nb carbonitride whose maximum length is 1 to 100 μm will be $4.0\times10^{-2}/\mu m^2$ or less in the Ni-based alloy produced. Note that the specific heat treatment may be performed multiple times.

[Preferable Form (3) of Ni-Based Alloy of Second Embodiment]

In the above-described Ni-based alloy, the grain size number conforming to ASTM E112 may be 0.0 or more, and the total number of Nb carbonitride whose maximum length is 1 to 100 μm may be $4.0\times10^{-2}/\mu m^2$ or less.

In this case, preferably, hot working at an area reduction ratio of 35.0% or more is performed at least one time for the Ni-based alloy starting material which has been heated to 1000 to 1300° C. in the above-described segregation reducing step, and the heat treatment in which the holding temperature is 1000 to 1300° C. and the holding time is 1.0 hour or more is performed at least one time in the above-described segregation reducing step.

Example 1

A liquid alloy was melted by electric furnace melting. The melted liquid alloy was solidified by a continuous casting process or an ingot-making process to produce a Ni-based alloy starting material (cast piece or ingot) having the chemical composition shown in Table 1. The Ni-based alloy starting materials of Test Nos. 1 to 5 and 8 were cast pieces. The section perpendicular to the longitudinal direction of the cast piece was 600×285 mm. The Ni-based alloy starting materials of Test Nos. 6 and 7 were ingots. The section perpendicular to the longitudinal direction of the ingot was 500 mm×500 mm.

TABLE 1

| Test | Chemical composition (unit is mass %, the balance being Ni and impurities) | | | | | | | | | | | | | | | | |
|---|---|---|---|---|---|---|---|---|---|---|---|---|---|---|---|---|---|
| No. | C | Si | Mn | P | S | Cr | Mo | Nb | Ta | Nb + Ta | Ti | Al | Fe | N | O | Co | Cu |
| 1 | 0.021 | 0.12 | 0.19 | 0.012 | 0.0003 | 20.9 | 8.4 | 3.22 | 0.002 | 3.222 | 0.16 | 0.15 | 4.50 | 0.006 | 0.0010 | 0.57 | 0.09 |
| 2 | 0.016 | 0.17 | 0.16 | 0.010 | 0.0002 | 21.0 | 8.6 | 3.23 | 0.002 | 3.232 | 0.18 | 0.27 | 4.10 | 0.007 | 0.0009 | 0.51 | 0.08 |
| 3 | 0.021 | 0.12 | 0.19 | 0.012 | 0.0003 | 20.9 | 8.4 | 3.22 | 0.002 | 3.222 | 0.16 | 0.15 | 4.50 | 0.006 | 0.0010 | 0.57 | 0.09 |
| 4 | 0.016 | 0.17 | 0.16 | 0.010 | 0.0002 | 21.0 | 8.6 | 3.23 | 0.002 | 3.232 | 0.18 | 0.27 | 4.10 | 0.007 | 0.0009 | 0.51 | 0.08 |
| 5 | 0.018 | 0.06 | 0.15 | 0.010 | 0.0002 | 21.2 | 8.9 | 3.70 | 0.002 | 3.702 | 0.20 | 0.17 | 3.89 | 0.007 | 0.0011 | 0.58 | 0.09 |
| 6 | 0.019 | 0.05 | 0.15 | 0.012 | 0.0003 | 21.2 | 8.5 | 3.28 | 0.002 | 3.282 | 0.18 | 0.15 | 3.49 | 0.011 | 0.0022 | 0.48 | 0.09 |
| 7 | 0.019 | 0.05 | 0.15 | 0.012 | 0.0003 | 21.2 | 8.5 | 3.28 | 0.002 | 3.282 | 0.18 | 0.15 | 3.49 | 0.011 | 0.0022 | 0.48 | 0.09 |
| 8 | 0.019 | 0.05 | 0.15 | 0.012 | 0.0003 | 21.2 | 8.5 | 3.28 | 0.002 | 3.282 | 0.18 | 0.15 | 3.49 | 0.011 | 0.0022 | 0.48 | 0.09 |

A dendrite secondary arm spacing $D_{II}$ was measured by the following method for the produced Ni-based alloy starting material (cast piece) to determine a solidification cooling rate $V_R$ (° C./min) of the Ni-based alloy starting material of each test number. Specifically, a sample was collected at a W/4 depth position of a cross section perpendicular to the longitudinal direction at a longitudinal central position of the Ni-based alloy starting material. Of the surface of the sample, a surface parallel with the above-described cross section was subjected to mirror polishing, and was thereafter etched with aqua regia. The etched surface was observed by an optical microscope of 400 times magnification to generate a photographic image of an observation field of view of 200 μm×200 μm. Using the obtained photographic image, dendrite secondary arm spacings (μm) at arbitrary 20 locations in the observation field of view were measured. An average of measured dendrite secondary arm spacings was defined as a dendrite secondary arm spacing $D_{II}$ (μm). By substituting the obtained dendrite secondary arm spacing $D_{II}$ for Formula (A), a solidification cooling rate $V_R$ (° C./min) was determined.

$$D_{II}=182V_R^{-0.294} \quad (A)$$

Further, the segregation reducing step shown in Table 2 was performed on the Ni-based alloys of Test Nos. 2 to 5, 7, and 8. In Test Nos. 2 and 3, the heat treatment was performed one time as the segregation reducing step. In Test No. 4, the heat treatment was performed (Heat treatment 1), thereafter, hot rolling was performed (Hot working 1), and the heat treatment was performed again (Heat treatment 2) after the hot rolling. In Test No. 5, Heat treatment 1, Hot working 1, Heat treatment 2, Hot working 2 (hot rolling), and Heat treatment 3 were performed in this order. In Test No. 7, Heat treatment 1 was performed. In Test No. 8, Heat treatment 1, Hot working 1, and Heat treatment 2 were performed in this order. That is, in Test Nos. 2, 3, and 7, only heat treatment at one time was performed. In Test No. 4, heat treatment at one time and complex treatment at one time were performed. In Test No. 5, heat treatment at one time and complex treatment at two times were performed. In Test No. 8, complex treatment at one time was performed. Note that in Test Nos. 1 and 6, the segregation reducing step was not performed.

Note that, in all of Test Nos. 4, 5, and 8, a solid material (that is, round-bar) having a cross section of circular shape was produced. Moreover, in all of Test Nos. 4, 5, and 8, Hot working 1 was performed soon after Heat treatment 1 was performed. In Test No. 5, Hot working 2 was performed soon after Heat treatment 2 was performed.

TABLE 2

| | Casting step | Segregation reducing step | | | | | | | |
|---|---|---|---|---|---|---|---|---|---|
| | | Heat treatment 1 | | Hot working 1 Area | Heat treatment 2 | | Hot working 2 Area | Heat treatment 3 | |
| Test No. | $V_R$ [° C./min] | Temperature [° C.] | Time [hr] | reduction ratio [%] | Temperature [° C.] | Time [hr] | reduction ratio [%] | Temperature [° C.] | Time [hr] |
| 1 | 5 | — | — | — | — | — | — | — | — |
| 2 | 5 | 1200 | 36 | — | — | — | — | — | — |
| 3 | 5 | 1200 | 96 | — | — | — | — | — | — |
| 4 | 5 | 1200 | 48 | 47.3 | 1200 | 24 | — | — | — |
| 5 | 5 | 1200 | 48 | 47.3 | 1200 | 24 | 85 | 1200 | 0.08 |
| 6 | 2 | — | — | — | — | — | — | — | — |
| 7 | 2 | 1200 | 150 | — | — | — | — | — | — |
| 8 | 2 | 1200 | 0.83 | 39.2 | 1200 | 85 | — | — | — |

| Test No. | F1 | Average Mo concentration [%] | Maximum Mo concentration [%] | Mo low-concentration region fraction [%] | SSRT test result | Corrosion rate [mm/month] |
|---|---|---|---|---|---|---|
| 1 | −0.62 | 8.4 | 11.8 | 4.0 | With sub-crack | 0.118 |
| 2 | −0.21 | 8.6 | 9.3 | 2.5 | With sub-crack | 0.124 |
| 3 | 0.06 | 8.4 | 9.1 | 1.9 | Without sub-crack | 0.058 |
| 4 | 0.33 | 8.6 | 9.1 | 0.5 | Without sub-crack | 0.030 |
| 5 | 0.38 | 8.9 | 9.4 | 0.0 | Without sub-crack | 0.027 |
| 6 | −0.82 | 8.5 | 13.6 | 8.0 | With sub-crack | 0.126 |
| 7 | 0.04 | 8.5 | 10.0 | 1.2 | Without sub-crack | 0.033 |
| 8 | 0.07 | 8.5 | 9.0 | 0.0 | Without sub-crack | 0.032 |

The holding temperature (° C.) and the holding time (hr) in each Heat treatment 1 to 3 were as shown in Table 2. The area reduction ratio $Rd_{n-1}$(%) in each Hot working 1, 2 was as shown in Table 2. Moreover, in each test number, F1 (=the right hand side of Formula (1)−the left hand side of Formula (1)) was determined. Determined F1 is shown in Table 2.

[Evaluation Test]

[Mo Concentration Measurement Test]

A sample for Mo concentration measurement test was collected in a section perpendicular to the longitudinal direction (cross section) of the Ni-based alloy of each test number after the segregation reducing step. Specifically, in each test number, a sample was collected from a W/4 depth position of the cross section. Out of the surfaces of the sample, the surface (observation surface) corresponding to the cross section was mirror polished, and thereafter line analysis by EPMA was performed with a beam diameter: 10 μm, a scanning length: 2000 μm, an irradiation time for one point: 3000 ms, and an irradiation pitch: 5 μm in an arbitrary field of view in the observation surface. In the scanning range of 2000 μm in which line analysis was performed, an average value of multiple Mo concentrations measured at a 5 μm pitch, and a maximum value of Mo concentration of the measured, multiple Mo concentrations were determined. Further, in the scanning length 2000 μm which was the measurement range, a total length (that is, a total length of Mo low-concentration region) of ranges in which measured points at which the Mo concentration had turned out to be less than 8.0% were continuous (ranges in which two or more points were continuous) was determined. The determined total length of Mo low-concentration region was used to determine a fraction of Mo low-concentration region (%) by the following formula.

Fraction of Mo low-concentration region=Total length of Mo low-concentration region (μm)/scanning length (2000 μm)×100

[Slow Strain Rate Tensile Test (SSRT)]

In a section perpendicular to the longitudinal direction of the Ni-based alloy of each Test No. after the segregation reducing step, a slow-strain-rate tensile test specimen was collected from the same position as the sample collection position in the Mo concentration measurement test. The length of the slow-strain-rate tensile test specimen was 80 mm, the length of a parallel part was 25.4 mm, and the diameter of the parallel part was 3.81 mm. The longitudinal direction of the slow-strain-rate tensile test specimen was parallel with the longitudinal direction of the Ni-based alloy. The slow strain rate tensile test (SSRT) was performed at a strain rate of $4.0\times10^{-6}$ $S^{-1}$ while immersing the slow-strain-rate tensile test specimen in a 25% NaCl+0.5% $CH_3COOH$ water solution of pH 2.8 to 3.1 and 232° C., which is saturated with 0.7 MPa of hydrogen sulfide, to cause the test specimen to be torn off. In the test specimen after the test, whether or not any sub-crack had occurred in a portion other than the torn-off part was visually confirmed. When any sub-crack had occurred, it was judged that stress corrosion cracking had occurred, and when no sub-crack was confirmed, it was judged that no stress corrosion cracking had occurred, and therefore excellent corrosion resistance (SCC resistance) had been achieved.

[Grain Boundary Corrosion Test]

In a section perpendicular to the longitudinal direction of the Ni-based alloy or each test number after the segregation reducing step, a sample was collected from the same position as the sample collection position in the Mo concentration measurement test. The size of test specimen was 40 mm×10 mm×3 mm. The collected specimen was used to perform a corrosion test specified by ASTM G28 Method A. Specifically, the weight of the test specimen before starting the corrosion test was measured. After the measurement, the test specimen was immersed in a 50% sulfuric acid/ferric sulfate solution for 120 hours. After elapse of 120 hours, the weight of the test specimen after the test was measured. From the change in weight of the measured test specimen, a corrosion rate (mm/month) of each test specimen was determined.

[Test Results]

Test results are shown in Table 2. Referring to Table 2, in Test Nos. 3 to 5, 7, and 8, the chemical composition of the Ni-based alloy was appropriate, and F1 was 0 or more, thus satisfying Formula (1) in the segregation reducing step. For that reason, in a section perpendicular to the longitudinal direction of the Ni-based alloy, the average concentration of Mo was 8.0% or more in mass %, the maximum value of Mo concentration was 11.0% or less in mass %, and further the area fraction of regions in which Mo concentration was less than 8.0% in mass % (the fraction of Mo low-concentration region) was less than 2.0%. As a result, no sub-crack was confirmed in the SSRT test. Further, the corrosion rate was 0.075 mm/month or less, thus exhibiting excellent corrosion resistance. Note that in the Ni-based alloys of Test Nos. 3 to 5, 7, and 8, the total number of Nb carbonitride whose maximum length was 1 to 100 μm was $4.0\times10^{-2}/\mu m^2$ or less.

Further, in Test Nos. 4, 5, and 8, hot working was performed before the final heat treatment in the segregation reducing step. As a result of that, compared with Test No. 3 in which hot working was not performed before heat treatment, the corrosion rate further decreased to be 0.055 mm/month or less.

On the other hand, in Test Nos. 1 and 6, the segregation reducing step was not performed after the Ni-based alloy starting material was produced by the casting step. For that reason, in a section perpendicular to the longitudinal direction of the Ni-based alloy, the maximum value of Mo concentration was more than 11.0% in mass %, and further the area fraction of regions in which Mo concentration was less than 8.0% in mass % (the fraction of Mo low-concentration region) was 2.0% or more. As a result of that, the sub-crack was confirmed in the SSRT test. Further, the corrosion rate was more than 0.075 mm/month.

In Test No. 2, although the heat treatment was performed in the segregation reducing step, F1 was less than 0, and did not satisfy Formula (1). For that reason, the fraction of Mo low-concentration region was 2.0% or more. As a result, the sub-crack was confirmed in the SSRT test. Further, the corrosion rate was more than 0.075 mm/month.

Example 2

The liquid alloy which was melted by electric furnace melting was solidified by a continuous casting process or ingot-making process to produce Ni-based alloy starting materials (cast pieces or ingots) having the chemical compositions of Table 3. The Ni-based alloy starting materials of Test Nos. 9 to 21 were cast pieces, and the section (cross section) perpendicular to the longitudinal direction of each cast piece was 600×285 mm. Note that in the F2 column of Table 3, F2 values (=(Ca+Nd+B)/S) of each test number are listed. Note that blank portions in Table 3 indicate that the content of a corresponding element was below a detection limit.

TABLE 3

| Test No. | Chemical composition (unit is mass %, the balance being Ni and impurities) | | | | | | | | | | | |
|---|---|---|---|---|---|---|---|---|---|---|---|---|
| | C | Si | Mn | P | S | Cr | Mo | Nb | Ta | Nb + Ta | Ti | Al |
| 9 | 0.014 | 0.11 | 0.21 | 0.012 | 0.0003 | 21.5 | 8.5 | 3.30 | | 3.300 | 0.22 | 0.11 |
| 10 | 0.016 | 0.07 | 0.19 | 0.007 | 0.0004 | 21.4 | 8.5 | 3.42 | | 3.420 | 0.19 | 0.08 |
| 11 | 0.016 | 0.17 | 0.16 | 0.010 | 0.0002 | 21.0 | 8.6 | 3.23 | 0.002 | 3.232 | 0.18 | 0.27 |
| 12 | 0.018 | 0.06 | 0.15 | 0.010 | 0.0002 | 21.2 | 8.9 | 3.70 | 0.002 | 3.702 | 0.20 | 0.17 |
| 13 | 0.020 | 0.11 | 0.21 | 0.011 | 0.0005 | 21.5 | 8.6 | 3.36 | | 3.360 | 0.20 | 0.09 |
| 14 | 0.020 | 0.14 | 0.20 | | 0.0005 | 21.5 | 8.6 | 3.36 | | 3.360 | 0.19 | 0.10 |
| 15 | 0.020 | 0.12 | 0.21 | 0.004 | 0.0006 | 21.5 | 8.5 | 3.32 | | 3.321 | 0.20 | 0.11 |
| 16 | 0.019 | 0.11 | 0.21 | 0.011 | 0.0004 | 21.5 | 8.6 | 3.39 | | 3.390 | 0.21 | 0.10 |
| 17 | 0.018 | 0.13 | 0.21 | 0.004 | 0.0004 | 21.5 | 8.6 | 3.40 | | 3.400 | 0.20 | 0.10 |
| 18 | 0.020 | 0.15 | 0.20 | 0.004 | 0.0005 | 21.4 | 8.6 | 3.38 | | 3.380 | 0.19 | 0.10 |
| 19 | 0.021 | 0.12 | 0.21 | 0.005 | 0.0005 | 21.6 | 8.6 | 3.37 | | 3.370 | 0.21 | 0.11 |
| 20 | 0.020 | 0.16 | 0.20 | 0.005 | 0.0005 | 21.5 | 8.5 | 3.34 | | 3.340 | 0.19 | 0.10 |
| 21 | 0.017 | 0.10 | 0.21 | 0.009 | 0.0003 | 21.6 | 8.6 | 3.44 | | 3.440 | 0.18 | 0.11 |

| Test No. | Chemical composition (unit is mass %, the balance being Ni and impurities) | | | | | | | | | |
|---|---|---|---|---|---|---|---|---|---|---|
| | Fe | N | O | Co | Cu | Ca | Nd | B | Ca + Nd + B | F2 |
| 9 | 3.02 | 0.011 | 0.0021 | 0.01 | 0.01 | | | | 0.0000 | 0.0 |
| 10 | 2.99 | 0.013 | 0.0013 | 0.04 | 0.01 | | | | 0.0000 | 0.0 |
| 11 | 4.10 | 0.007 | 0.0009 | 0.51 | 0.08 | 0.0005 | | | 0.0005 | 2.0 |
| 12 | 3.89 | 0.007 | | 0.58 | 0.09 | 0.0007 | | | 0.0007 | 2.8 |
| 13 | 2.94 | 0.012 | 0.0100 | | | | | 0.0001 | 0.0001 | 0.6 |
| 14 | 3.03 | 0.012 | 0.0040 | | | | | 0.0001 | 0.0001 | 0.6 |
| 15 | 3.03 | 0.011 | 0.0050 | | | | | 0.0001 | 0.0001 | 0.5 |
| 16 | 3.02 | 0.012 | 0.0090 | | | | 0.014 | 0.0001 | 0.0141 | 8.5 |
| 17 | 3.01 | 0.011 | 0.0050 | | | | 0.035 | 0.0001 | 0.0351 | 20.2 |
| 18 | 3.02 | 0.011 | 0.0110 | | | | 0.031 | 0.0019 | 0.0329 | 25.1 |
| 19 | 3.05 | 0.024 | 0.0070 | | | | 0.390 | 0.0021 | 0.3921 | 185.9 |
| 20 | 3.02 | 0.012 | 0.0110 | | | | 0.350 | 0.0017 | 0.3517 | 165.7 |
| 21 | 3.67 | 0.014 | 0.0010 | | 0.01 | | | 0.0001 | 0.0001 | 1.0 |

For the produced Ni-based alloy starting materials (cast pieces), the dendrite secondary arm spacing $D_{II}$ was measured by the above-described method to determine the solidification cooling rate $V_R$ (° C./min) of the Ni-based alloy starting material of each test number. As a result, as shown in Table 4, the solidification cooling rate $V_R$ was 5 (° C./min) in all the test numbers.

TABLE 4

| | | Segregation reducing step | | | | | | | | |
|---|---|---|---|---|---|---|---|---|---|---|
| | Casting step | Heat treatment 1 | | Hot working 1 Area | Heat treatment 2 | | Hot working 2 Area | Heat treatment 3 | | |
| Test No. | $V_R$ [° C./min] | Temperature [° C.] | Time [hr] | reduction ratio [%] | Temperature [° C.] | Time [hr] | reduction ratio [%] | Temperature [° C.] | Time [hr] | F1 |
| 9 | 5 | 1200 | 96 | — | — | — | — | — | — | 0.06 |
| 10 | 5 | 1200 | 48 | 47.3 | 1200 | 24 | — | — | — | 0.33 |
| 11 | 5 | 1200 | 96 | — | — | — | — | — | — | 0.06 |
| 12 | 5 | 1200 | 48 | 47.3 | 1200 | 24 | — | — | — | 0.33 |
| 13 | 5 | 1200 | 48 | 47.3 | 1200 | 24 | — | — | — | 0.33 |
| 14 | 5 | 1200 | 48 | 47.3 | 1200 | 24 | — | — | — | 0.33 |
| 15 | 5 | 1200 | 48 | 47.3 | 1200 | 24 | — | — | — | 0.33 |
| 16 | 5 | 1200 | 48 | 47.3 | 1200 | 24 | — | — | — | 0.33 |
| 17 | 5 | 1200 | 48 | 47.3 | 1200 | 24 | — | — | — | 0.33 |
| 18 | 5 | 1200 | 48 | 47.3 | 1200 | 24 | — | — | — | 0.33 |
| 19 | 5 | 1200 | 48 | 47.3 | 1200 | 24 | 85.0 | 1200 | 0.08 | 0.38 |
| 20 | 5 | 1200 | 48 | 47.3 | 1200 | 24 | 85.0 | 1200 | 0.08 | 0.38 |
| 21 | 5 | 1200 | 48 | 47.3 | 1200 | 24 | 85.0 | 1200 | 0.08 | 0.38 |

| Test No. | F2 | Average Mo concentration [%] | Maximum Mo concentration [%] | Mo low-concentration fraction [%] | SSRT test result | Corrosion rate [mm/month] | Reduction area after fraction [%] |
|---|---|---|---|---|---|---|---|
| 9 | 0.0 | 8.3 | 9.4 | 1.4 | Without corrosion | 0.030 | 24.9 |
| 10 | 0.0 | 8.6 | 9.5 | 0.9 | Without corrosion | 0.028 | 24.7 |
| 11 | 2.0 | 8.3 | 9.4 | 1.4 | Without corrosion | 0.030 | 50.1 |
| 12 | 2.8 | 8.6 | 9.5 | 0.9 | Without corrosion | 0.028 | 70.6 |
| 13 | 0.6 | 8.6 | 9.5 | 0.9 | Without corrosion | 0.028 | 31.3 |
| 14 | 0.6 | 8.6 | 9.5 | 0.9 | Without corrosion | 0.028 | 30.0 |
| 15 | 0.5 | 8.6 | 9.5 | 0.9 | Without corrosion | 0.028 | 31.7 |
| 16 | 8.5 | 8.6 | 9.5 | 0.9 | Without corrosion | 0.028 | 83.2 |
| 17 | 20.2 | 8.6 | 9.5 | 0.9 | Without corrosion | 0.028 | 80.1 |
| 18 | 25.1 | 8.6 | 9.5 | 0.9 | Without corrosion | 0.028 | 85.9 |
| 19 | 185.9 | 8.5 | 9.1 | 0.5 | Without corrosion | 0.029 | 82.4 |
| 20 | 165.7 | 8.5 | 9.1 | 0.5 | Without corrosion | 0.029 | 84.4 |
| 21 | 1.0 | 8.5 | 9.1 | 0.5 | Without corrosion | 0.029 | 34.2 |

The segregation reducing step was performed on the Ni-based alloy of each test number. Specifically, in Test Nos. 9 and 11, the heat treatment was performed only one time, and the hot working step was not performed. The holding temperature of the heat treatment was 1200° C., and the holding time was 96 hours. As a result, each F1 was 0.06, thus satisfying Formula (1).

In any of Test Nos. 10 and 12 to 18, the heat treatment was performed (Heat treatment 1), thereafter hot rolling was performed (Hot working 1), and the heat treatment was performed again after the hot rolling (Heat treatment 2). The holding temperature in Heat treatment 1 was 1200° C., and the holding time was 48 hours. The area reduction ratio in Hot working 1 was 47.3%. The holding temperature in Heat treatment 2 was 1200° C. and the holding time was 24 hours. As a result, each F1 (=the right hand side of Formula (1)−the left hand side of Formula (1)) was 0.33, thus satisfying Formula (1).

In Test Nos. 19 to 21, Heat treatment 1, Hot working 1, Heat treatment 2, Hot working 2, and Heat treatment 3 were performed in this order. The holding temperature of Heat treatment 1 was 1200° C., and the holding time was 48 hours. The cumulative area reduction ratio in Hot working 1 was 47.3%. The holding temperature in Heat treatment 2 was 1200° C., and the holding time was 24 hours. The cumulative area reduction ratio in Hot working 2 was 85.0%. The holding temperature in Heat treatment 3 was 1200° C., and the holding time was 0.08 hours. As a result, each F1 was 0.38, thus satisfying Formula (1).

By the steps described above, Ni-based alloys of Test Nos. 9 to 21 were produced. Note that in all of Test Nos. 9 to 21, secondary melting was not performed on the Ni-based all starting material after the casting step. The Ni-based alloys of Test Nos. 9 and 11 were cast pieces, and the Ni-based alloys of Test Nos. 10, and 12 to 21 were each a solid material (that is a round-bar) which had a cross section of a circular shape. Note that in Test Nos. 10, and 12 to 21, Hot working 1 was performed soon after Heat treatment 1 was performed. In Test Nos. 19 to 21, Hot working 2 was performed soon after Heat treatment 2 was performed.

[Hot Workability Evaluation Test]

The Ni-based alloy of each test number was used to perform the following tensile test. Tensile test specimens were collected from the Ni-based alloys. The tensile test specimen corresponded to 14A test specimen of JIS standard. In each test number, a tensile test specimen was collected from a W/4 depth position of a cross section. The tensile test specimen was heated to 900° C. By using a tensile test specimen of 900° C., tensile test was performed at a strain rate of 10/sec in the atmosphere to measure reduction area after fraction (%). When the reduction area after fraction was 35.0% or more, it was judged that hot workability was excellent. Measurement results are shown in Table 3.

[Test Results]

Referring to Table 3, all of Test Nos. 9 to 21 satisfied Formula (1). For that reason, in a section perpendicular to the longitudinal direction of the Ni-based alloy, the average concentration of Mo was 8.0% or more in mass %, the maximum value of Mo concentration was 11.0% or less in mass %, and further the area fraction of regions in which Mo concentration was less than 8.0% in mass % was less than 2.0%. As a result, no sub-crack was confirmed in the SSRT test. Further, the corrosion rate was 0.075 mm/month or less, thus exhibiting excellent corrosion resistance. Note that in the Ni-based alloys of Test Nos. 9 to 21, a total number of Nb carbonitride whose maximum length was 1 to 100 μm was $4.0\times10^{-2}/\mu m^2$ or less.

Further, in all of Test Nos. 11, 12, and 16 to 20, the chemical compositions were appropriate, and F2 was 2.0 or more, thus satisfying Formula (2). For that reason, all of the reduction area after fractions were 35.0% or more (more specifically, 45.0% or more), thus exhibiting excellent hot workability.

Example 3

The grain size numbers of Ni-based alloys of Test No. 5 of Example 1 and Test No. 12 of Example 2 were determined by the following method. The Ni-based alloy was divided into 5 equal sections in the axial direction to identify an axially central position of each section. In each section, sample collection positions were identified at a 90 degree pitch around the axis (around the longitudinal direction) at an axially central position. Samples were collected from the W/4 depth positions at each identified sample collection position. The observation surface of sample was a section perpendicular to the axial direction of the Ni-based alloy, and the area of the observation surface was 40 $mm^2$. According to the above-described method, 4 samples per each section, and 20 samples in all the sections were collected. The observation surface of each collected sample was etched by using the Kalling's reagent to cause grain boundaries in the surface to appear. Observing the etched observation surface, the grain size number was determined conforming to ASTM E112. An average value of the grain size numbers determined from 20 samples was defined as the grain size number conforming to ASTM E112 in an Ni-based alloy.

As a Comparative Example, a Ni-based alloy starting material of Test No. 22 having the chemical composition shown in Table 5 was prepared. The Ni-based alloy starting material was a cast piece, a section perpendicular to the longitudinal direction of the cast piece was 600×285 mm. The chemical composition of Test No. 22 was the same as that of Test No. 5.

TABLE 5

| Test | Chemical composition (unit is mass %, the balance being Ni and impurities) | | | | | | | | | | | |
|---|---|---|---|---|---|---|---|---|---|---|---|---|
| No. | C | Si | Mn | P | S | Cr | Mo | Nb | Ta | Nb + Ta | Ti | Al |
| 22 | 0.018 | 0.06 | 0.15 | 0.010 | 0.0002 | 21.2 | 8.9 | 3.70 | 0.002 | 3.702 | 0.20 | 0.17 |
| 5 | 0.018 | 0.06 | 0.15 | 0.010 | 0.0002 | 21.2 | 8.9 | 3.70 | 0.002 | 3.702 | 0.20 | 0.17 |
| 12 | 0.018 | 0.06 | 0.15 | 0.010 | 0.0002 | 21.2 | 8.9 | 3.70 | 0.002 | 3.702 | 0.20 | 0.17 |

| Test | Chemical composition (unit is mass %, the balance being Ni and impurities) | | | | | | | | | |
|---|---|---|---|---|---|---|---|---|---|---|
| No. | Fe | N | O | Co | Cu | Ca | Nd | B | Ca + Nd + B | F2 |
| 22 | 3.89 | 0.007 | 0.001 | 0.58 | 0.09 | | | | | |
| 5 | 3.89 | 0.007 | 0.001 | 0.58 | 0.09 | | | | | |
| 12 | 3.89 | 0.007 | | 0.58 | 0.09 | 0.0007 | | | 0.0007 | 2.8 |

For the Ni-based alloy starting material (cast piece) of Test No. 22, the dendrite secondary arm spacing $D_{II}$ was measured by the same method as in Example 1 to determine the solidification cooling rate $V_R$ (° C./min) of the Ni-based alloy starting material of each test number. As a result, the solidification cooling rate $V_R$ was 5° C./min as shown in Table 6.

TABLE 6

| | | Segregation reducing step | | | | | | | | | |
|---|---|---|---|---|---|---|---|---|---|---|---|
| | Casting step | Heat treatment 1 | | Hot working 1 Cumulative area | Heat treatment 2 | | Hot working 2 Cumulative area | Heat treatment 3 | | | Grain |
| Test No. | $V_R$ [° C./min] | Temperature [° C.] | Time [hr] | reduction ratio [%] | Temperature [° C.] | Time [hr] | reduction ratio [%] | Temperature [° C.] | Time [hr] | F1 | size number |
| 22 | 5 | 1200 | 48 | 31.3 | 1200 | 24 | 62.6 | 1200 | 0.08 | 0.30 | −2.0 |
| 5 | 5 | 1200 | 48 | 47.3 | 1200 | 24 | 85.0 | 1200 | 0.08 | 0.38 | 2.0 |
| 12 | 5 | 1200 | 48 | 47.3 | 1200 | 24 | — | — | — | 0.33 | 0.0 |

For the Ni-based alloy starting material of Test No. 22, the segregation reducing step as shown in Table 6 was performed. Compared with the production conditions of Test No. 5, the area reduction ratio of the first hot working was 31.3%. Moreover, the cumulative area reduction ratio of the second hot working was 62.6%, and the area reduction ratio in the second hot working was 31.3%. That is, in Test No. 22, both the area reduction ratios in each hot working were less than 35.0%. For Test No. 22 as well, the grain size number was determined by the same method as in Test No. 5.

As a result of determining the grain size number, in Test No. 5, the grain size number conforming to ASTM E112 was 0.0 or more (2.0), and in Test No. 12, the grain size number conforming to ASTM E112 was 0.0. On the other hand, in Test No. 22, the grain size number conforming to ASTM E112 was less than 0.0 (−2.0).

Example 4

The total number of coarse Nb carbonitride of the Ni-based alloy of Test No. 4 of Example 1 was determined by the following method. The Ni-based alloy was divided into 5 equal sections in the axial direction and an axially central position of each section was identified. In each section, sample collection positions were identified at a 90 degree pitch around the axis (around the longitudinal direction) at an axially central position. A samples was collected from a wall thickness central position at each identified sample collection position. The observation surface of sample was a section perpendicular to the axial direction of the Ni-based alloy. Nb carbonitride was identified by EPMA in an arbitrary one field of view (400 μm×400 μm) in each observation surface (a total of 20). A maximum length of the identified Nb carbonitride was measured. As described so far, among straight lines connecting arbitrary two points on the interface between Nb carbonitride and the mother phase, the value of the longest straight line is defined as the maximum length of the Nb carbonitride. After measuring the maximum length of each Nb carbonitride, Nb carbonitride whose maximum length was 1 to 100 μm (coarse Nb carbonitride) was identified, and a total number of coarse Nb carbonitride in all the 20 fields of view was determined. Based on the obtained total number, a total number (/$\mu m^2$) of coarse Nb carbonitride was determined.

As a Comparative Example, a Ni-based alloy of Test No. 23 shown in Table 7 was prepared. The Ni-based alloy starting material was a cast piece, a section perpendicular to the longitudinal direction of the cast piece was 600×285 mm. The chemical composition of Test No. 23 was the same as that of Test No. 4.

TABLE 7

| Test No. | Chemical composition (unit is mass %, the balance being Ni and impurities) | | | | | | | | | | | | | | | | |
|---|---|---|---|---|---|---|---|---|---|---|---|---|---|---|---|---|---|
| | C | Si | Mn | P | S | Cr | Mo | Nb | Ta | Nb + Ta | Ti | Al | Fe | N | O | Co | Cu |
| 23 | 0.016 | 0.17 | 0.16 | 0.010 | 0.0002 | 21.0 | 8.6 | 3.23 | 0.002 | 3.232 | 0.18 | 0.27 | 4.10 | 0.007 | 0.0009 | 0.51 | 0.08 |
| 4 | 0.016 | 0.17 | 0.16 | 0.010 | 0.0002 | 21.0 | 8.6 | 3.23 | 0.002 | 3.232 | 0.18 | 0.27 | 4.10 | 0.007 | 0.0009 | 0.51 | 0.08 |

For the Ni-based alloy starting material of Test No. 23, the segregation reducing step shown in Table 8 was performed. Specifically, in Test No. 23, the first heat treatment (Heat treatment 1) was performed at the same temperature as in Test No. 4, and thereafter, hot rolling (Hot working 1) was performed at an area reduction ratio as in Test No. 4, and second heat treatment (Heat treatment 2) was performed again at the same temperature as in Test No. 4, after the hot rolling. However, the holding times in Heat treatment 1 and Heat treatment 2 were both 50 minutes (0.83 hours), and were less than 1 hour. In Test No. 23 as well, as in Test No. 4, the total number of coarse Nb carbonitride was determined.

TABLE 8

| Test No. | Casting step | Segregation reducing step | | | | | | Total number of coarse Nb carbonitride (/$\mu m^2$) | Reduction area after fraction [%] |
|---|---|---|---|---|---|---|---|---|---|
| | | Heat treatment 1 | | Hot working 1 Cumulative | Heat treatment 2 | | | | |
| | $V_R$ [° C./min] | Temperature [° C.] | Time [hr] | area reduction ratio [%] | Temperature [° C.] | Time [hr] | F1 | | |
| 23 | 5 | 1200 | 0.83 | 47.3 | 1200 | 0.83 | −0.47 | 0.13 | 13.2 |
| 4 | 5 | 1200 | 48 | 47.3 | 1200 | 24 | 0.33 | $5.2 \times 10^{-3}$ | 69.6 |

Further, for the Ni-based alloys of Test Nos. 4 and 23, the hot workability evaluation test was performed by the same method as in Example 2 to determine the reduction area after fraction (%).

Although the total number of coarse Nb carbonitride was $4.0\times10^{-2}/\mu m^2$ or less in Test No. 4, it was more than $4.0\times10^{-2}/\mu m^2$ in Test No. 23. As a result of that, while the reduction area after fraction became more than 35.0% in Test No. 4, the reduction area after fraction was less than 35.0% in Comparative Example.

So far, embodiments of the present invention have been described. However, the above-described embodiments are merely examples for practicing the present invention. Therefore, the present invention will not be limited to the above-described embodiments and can be practiced by appropriately altering the above-described embodiments within a range not departing from the spirit thereof.

The invention claimed is:

1. A Ni-based alloy, having
a chemical composition consisting of: in mass %,
C: 0.100% or less,
Si: 0.50% or less,
Mn: 0.50% or less,
P: 0.015% or less,
S: 0.0150% or less,
Cr: 20.0 to 23.0%,
Mo: 8.0 to 10.0%,
one or more elements selected from the group consisting of Nb and Ta: 3.150 to 4.150%,
Ti: 0.05 to 0.40%,
Al: 0.05 to 0.40%,
Fe: 0.05 to 5.00%,
N: 0.100% or less,
O: 0.1000% or less,
Co: 0 to 1.00%,
Cu: 0 to 0.50%,
one or more elements selected from the group consisting of Ca, Nd, and B: 0 to 0.5000%, and
the balance being Ni and impurities, wherein
in a section perpendicular to a longitudinal direction of the Ni-based alloy, an average concentration of Mo is 8.0% or more in mass %;
a maximum value of the Mo concentration is 11.0% or less in mass %;
and further an area fraction of a region in which the Mo concentration is less than 8.0% in mass % is less than 2.0%; and
a corrosion rate measured by a corrosion test conforming to ASTM G28 Method A is 0.075 mm/month or less.

2. The Ni-based alloy according to claim 1, wherein
the chemical composition contains
one or more elements selected from the group consisting of Ca, Nd, and B by a content that satisfies Formula (2):

$$(Ca+Nd+B)/S\geq2.0 \quad (2)$$

where, each symbol of element in Formula (2) is substituted by a content in atomic % of a corresponding element.

3. The Ni-based alloy according to claim 1, wherein
a grain size number conforming to ASTM E112 is 0.0 or more.

4. The Ni-based alloy according to claim 2, wherein
a grain size number conforming to ASTM E112 is 0.0 or more.

5. The Ni-based alloy according to claim 1, wherein
a total number of Nb carbonitride whose maximum length is 1 to 100 μm is $4.0\times10^{-2}/\mu m^2$ or less in the Ni-based alloy.

6. The Ni-based alloy according to claim 2, wherein
a total number of Nb carbonitride whose maximum length is 1 to 100 μm is $4.0\times10^{-2}/\mu m^2$ or less in the Ni-based alloy.

7. The Ni-based alloy according to claim 3, wherein
a total number of Nb carbonitride whose maximum length is 1 to 100 μm is $4.0\times10^{-2}/\mu m^2$ or less in the Ni-based alloy.

8. The Ni-based alloy according to claim 4, wherein
a total number of Nb carbonitride whose maximum length is 1 to 100 μm is $4.0\times10^{-2}/\mu m^2$ or less in the Ni-based alloy.

9. A method for producing a Ni-based alloy according to claim 1, comprising:
a casting step of casting a liquid alloy to produce a Ni-based alloy starting material, which has
a chemical composition consisting of: in mass %,
C: 0.100% or less,
Si: 0.50% or less,
Mn: 0.50% or less,
P: 0.015% or less,
S: 0.0150% or less,
Cr: 20.0 to 23.0%,
Mo: 8.0 to 10.0%,
one or more elements selected from the group consisting of Nb and Ta: 3.150 to 4.150%,
Ti: 0.05 to 0.40%,
Al: 0.05 to 0.40%,
Fe: 0.05 to 5.00%,
N: 0.100% or less,
O: 0.1000% or less,
Co: 0 to 1.00%,
Cu: 0 to 0.50%,
one or more elements selected from the group consisting of Ca, Nd, and B: 0 to 0.5000%, and
the balance being Ni and impurities; and
a segregation reducing step of performing, on the Ni-based alloy starting material produced by the casting step,
heat treatment, or
the heat treatment and, after the heat treatment, complex treatment including hot working and heat treatment after the hot working, to satisfy Formula (1):

[Expression 1]

$$V_R^{-0.294} \leq 1.27\times10^3 \sum_{n=1}^{N} \sqrt{\left(1-\frac{Rd_{n-1}}{100}\right)^{-1}\cdot\exp\left(\frac{-2.89\times10^4}{T_n+273}\right)\cdot t_n} \quad (1)$$

where, each symbol in Formula (1) is as follows:
$V_R$: Solidification cooling rate (° C./min) of the liquid alloy in the casting step,
$T_n$: Holding temperature (° C.) in the n-th heat treatment,
$t_n$: Holding time (hr) at the holding temperature in the n-th heat treatment,
$Rd_{n-1}$: Cumulative area reduction ratio (%) of the Ni-based alloy starting material before the n-th heat treatment, and
N: Total number of the heat treatment.

10. The method for producing a Ni-based alloy according to claim 9, wherein the holding temperature is 1000 to 1300° C.

11. The method for producing a Ni-based alloy according to claim 10, wherein in the segregation reducing step, the complex treatment is performed one or more times, and hot working is performed at least one time at an area reduction ratio of 35.0% or more on the Ni-based alloy starting material which has been heated to 1000 to 1300° C.

12. The method for producing a Ni-based alloy according to claim 10, wherein in the segregation reducing step, the heat treatment in which the holding temperature is 1000 to 1300° C. and the holding time is 1.0 hour or more is performed at least one time.

13. The method for producing a Ni-based alloy according to claim 11, wherein in the segregation reducing step, the heat treatment in which the holding temperature is 1000 to 1300° C. and the holding time is 1.0 hour or more is performed at least one time.

14. The method for producing a Ni-based alloy according to claim 9, wherein the chemical composition contains one or more elements selected from the group consisting of Ca, Nd, and B by a content that satisfies Formula (2):

$$(Ca+Nd+B)/S \geq 2.0 \quad (2)$$

where, each symbol of element in Formula (2) is substituted by a content in atomic % (at %) of a corresponding element.

15. The method for producing a Ni-based alloy according to claim 10, wherein the chemical composition contains one or more elements selected from the group consisting of Ca, Nd, and B by a content that satisfies Formula (2):

$$(Ca+Nd+B)/S \geq 2.0 \quad (2)$$

where, each symbol of element in Formula (2) is substituted by a content in atomic % (at %) of a corresponding element.

16. The method for producing a Ni-based alloy according to claim 11, wherein the chemical composition contains one or more elements selected from the group consisting of Ca, Nd, and B by a content that satisfies Formula (2):

$$(Ca+Nd+B)/S \geq 2.0 \quad (2)$$

where, each symbol of element in Formula (2) is substituted by a content in atomic % (at %) of a corresponding element.

17. The method for producing a Ni-based alloy according to claim 12, wherein the chemical composition contains one or more elements selected from the group consisting of Ca, Nd, and B by a content that satisfies Formula (2):

$$(Ca+Nd+B)/S \geq 2.0 \quad (2)$$

where, each symbol of element in Formula (2) is substituted by a content in atomic % (at %) of a corresponding element.

18. The method for producing a Ni-based alloy according to claim 13, wherein the chemical composition contains one or more elements selected from the group consisting of Ca, Nd, and B by a content that satisfies Formula (2):

$$(Ca+Nd+B)/S \geq 2.0 \quad (2)$$

where, each symbol of element in Formula (2) is substituted by a content in atomic % (at %) of a corresponding element.

* * * * *